US007768481B2

(12) United States Patent
Jung et al.

(10) Patent No.: US 7,768,481 B2
(45) Date of Patent: Aug. 3, 2010

(54) PLASMA DISPLAY APPARATUS

(75) Inventors: Yun Kwon Jung, Gumi-si (KR); Yang Ki An, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 1060 days.

(21) Appl. No.: 11/480,420

(22) Filed: Jul. 5, 2006

(65) Prior Publication Data

US 2007/0132670 A1 Jun. 14, 2007

(30) Foreign Application Priority Data

Dec. 12, 2005 (KR) ..... 10-2005-0122199

(51) Int. Cl.
*G09G 3/28* (2006.01)

(52) U.S. Cl. ..... 345/68; 345/60

(58) Field of Classification Search ..... 345/60–72, 345/204–214, 169.1, 169.4; 315/169.1, 169.4
See application file for complete search history.

(56) References Cited

U.S. PATENT DOCUMENTS

| | | | | |
|---|---|---|---|---|
| 5,654,728 | A * | 8/1997 | Kanazawa et al. | 345/68 |
| 5,844,373 | A | 12/1998 | Yao et al. | 315/205 |
| 6,686,912 | B1 * | 2/2004 | Kishi et al. | 345/211 |
| 7,102,596 | B2 * | 9/2006 | Kang et al. | 345/60 |
| 7,403,199 | B2 * | 7/2008 | Kwak et al. | 345/211 |
| 7,439,942 | B2 * | 10/2008 | Choi | 345/60 |
| 2003/0218431 | A1 | 11/2003 | Roh et al. | 315/169.1 |

FOREIGN PATENT DOCUMENTS

| | | |
|---|---|---|
| EP | 1 065 650 | 1/2001 |
| EP | 1 227 464 | 7/2002 |
| EP | 1 414 006 | 4/2004 |
| EP | 1 548 694 | 6/2005 |
| EP | 1 550 995 | 7/2005 |
| EP | 1 681 666 | 7/2006 |
| EP | 1 724 745 | 11/2006 |
| KR | 1020040071491 | 8/2004 |

OTHER PUBLICATIONS

European Search Report dated Apr. 7, 2007.
European Office Action dated Feb. 8, 2008.

* cited by examiner

*Primary Examiner*—David L Lewis
(74) *Attorney, Agent, or Firm*—KED & Associates, LLP

(57) ABSTRACT

A plasma display apparatus is disclosed. A scan driver of the plasma display apparatus supplies a voltage of a scan signal of a negative polarity direction and a voltage of a sustain signal to a scan electrode using one voltage source. Further, a sustain driver of the plasma display apparatus supplies a voltage of a sustain signal and a sustain bias voltage to a sustain electrode using one voltage source.

21 Claims, 22 Drawing Sheets

PLASMA DISPLAY APPARATUS

This Nonprovisional application claims priority under 35 U.S.C. §119(a) on Patent Application No. 2005-0122199 filed in Korea on Dec. 12, 2005 the entire contents of which are hereby incorporated by reference.

BACKGROUND OF THE INVENTION

1. Field of the Invention

This document relates to a display apparatus, and more particularly, to a plasma display apparatus.

2. Description of the Background Art

Out of display apparatuses, a plasma display apparatus comprises a plasma display panel and a driver for driving the plasma display panel.

The plasma display panel comprises a front panel, a rear panel, and barrier ribs formed between the front panel and the rear panel. The barrier ribs form discharge cells. Each of the discharge cells is filled with an inert gas containing a main discharge gas such as neon (Ne), helium (He) or a Ne—He gas mixture and a small amount of xenon (Xe).

The plurality of discharge cells form one pixel. For example, a red (R) discharge cell, a green (G) discharge cell and a blue (B) discharge cell form one pixel.

When a high frequency voltage generates a discharge, the inert gas within the discharge cells generates vacuum ultraviolet rays. The vacuum ultraviolet rays emit a phosphor formed between the barrier ribs such that the image is displayed. Since the above-described plasma display panel can be manufactured to be thin and light, the plasma display panel has been considered as a next generation display apparatus.

A plurality of electrodes, for example, a scan electrode, a sustain electrode and an address electrode are formed in the plasma display panel. A discharge is generated by supplying a predetermined driving voltage to the plurality of electrodes such that an image is displayed.

The driver for supplying the predetermined driving voltage for the display of the image is connected to the electrodes of the plasma display panel.

For example, a data driver is connected to the address electrode of the plasma display panel, and a scan driver is connected to the scan electrode of the plasma display panel.

As described above, the plasma display apparatus comprises the plasma display panel comprising the plurality of electrodes and the driver for supplying the predetermined driving voltage to the plurality of electrodes of the plasma display panel.

The plasma display apparatus comprises a plurality of voltage sources for generating the predetermined driving voltage, which will be supplied to the plurality of electrodes of the plasma display panel.

For example, the plasma display apparatus comprises a sustain voltage source, a setup voltage source and a negative polarity scan voltage source. The sustain voltage source supplies a voltage of a sustain signal to the scan electrode of the plasma display panel. The setup voltage source supplies a voltage of a rising signal, that is, a setup voltage to the scan electrode. The negative polarity scan voltage source supplies a voltage of a falling signal, that is, a set-down voltage, and a voltage of a scan signal of a negative polarity direction to the scan electrode.

The plasma display apparatus further comprises a sustain voltage source for supplying a voltage of a sustain signal, and a sustain reference voltage source for supplying a sustain reference voltage to the sustain electrode of the plasma display panel.

As described above, since the plasma display apparatus comprises the plurality of voltage sources, the fabricating cost of the plasma display apparatus increases.

SUMMARY OF THE INVENTION

Accordingly, an object of the present invention is to solve at least the problems and disadvantages of the background art.

This document provides a plasma display apparatus for reducing the fabricating cost by integrating two or more different voltage sources into one common voltage source.

According to one aspect, there is provided a plasma display apparatus comprising a plasma display panel comprising a scan electrode and an address electrode, and a driver for supplying a voltage of a scan signal of a negative polarity direction and a voltage of a sustain signal to the scan electrode using one voltage source.

According to another aspect, there is provided a plasma display apparatus comprising a plasma display panel comprising a scan electrode and an address electrode, and a driver for supplying a voltage of a scan signal of a negative polarity direction, a voltage of a falling signal with a gradually falling voltage, and a voltage of a sustain signal to the scan electrode using one voltage source.

According to still another aspect, there is provided a plasma display apparatus comprising a plasma display panel comprising a sustain electrode and an address electrode, and a driver for supplying a voltage of a sustain signal and a sustain bias voltage to the sustain electrode using one voltage source.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
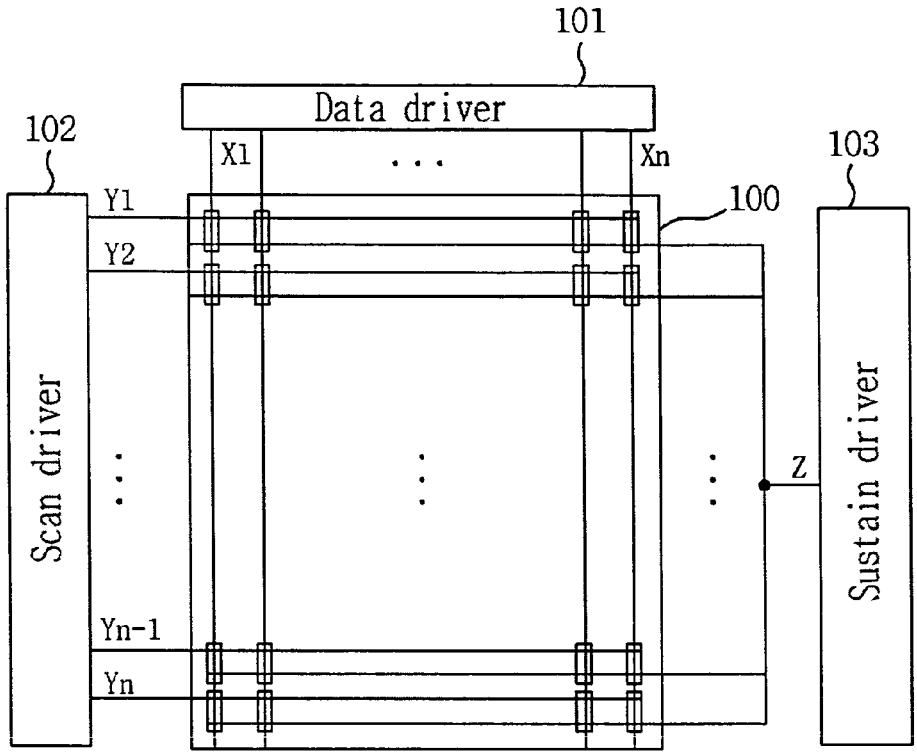
FIG. 1 illustrates a plasma display apparatus according to one embodiment of the present invention.

Preferred embodiments of the present invention will be described in a more detailed manner with reference to the drawings.

A plasma display apparatus according to embodiments of the present invention comprises a plasma display panel comprising a scan electrode and an address electrode, and a driver for supplying a voltage of a scan signal of a negative polarity direction and a voltage of a sustain signal to the scan electrode using one voltage source.

The voltage source may be a sustain voltage source.

The driver may comprise a sustain voltage supply control unit for controlling the voltage of the sustain signal supplied to the scan electrode, a negative polarity scan voltage generating unit for generating the voltage of the scan signal of the negative polarity direction, and a scan voltage supply control unit for controlling the voltage of the scan signal of the negative polarity direction supplied to the scan electrode.

The negative polarity scan voltage generating unit may comprise a voltage storing unit for storing the voltage of the sustain signal, and a buffer unit linked with the voltage storing unit.

The voltage storing unit may comprise a first capacitor for storing the voltage of the sustain signal.

The negative polarity scan voltage generating unit may comprise a voltage storing unit for storing the voltage of the sustain signal, a buffer unit linked with the voltage storing unit, and a voltage control unit for controlling a magnitude of the voltage stored in the voltage storing unit.

The voltage control unit may be a variable voltage source.

One terminal of the voltage control unit may be connected to a low level voltage supply source for supplying a voltage less than the sustain voltage. The other terminal may be grounded. The low level voltage supply source may be a data voltage source for supplying a data signal to the address electrode.

A plasma display apparatus according to the embodiments of the present invention comprise a plasma display panel comprising a scan electrode and an address electrode, and a driver for supplying a voltage of a scan signal of a negative polarity direction, a voltage of a falling signal with a gradually falling voltage, and a voltage of a sustain signal to the scan electrode using one voltage source.

The voltage source may be a sustain voltage source.

The driver may comprise a sustain voltage supply control unit for controlling the voltage of the sustain signal supplied to the scan electrode, a negative polarity scan voltage generating unit for generating the voltage of the scan signal of the negative polarity direction, a scan voltage supply control unit for controlling the voltage of the scan signal of the negative polarity direction supplied to the scan electrode, and a falling voltage supply control unit for controlling the voltage of the falling signal supplied to the scan electrode.

The negative polarity scan voltage generating unit may comprise a voltage storing unit for storing the voltage of the sustain signal, and a buffer unit linked with the voltage storing unit.

The negative polarity scan voltage generating unit may comprise a voltage storing unit for storing the voltage of the sustain signal, a buffer unit linked with the voltage storing unit, and a voltage control unit for controlling a magnitude of the voltage stored in the voltage storing unit.

The voltage control unit may be a variable voltage source.

One terminal of the voltage control unit may be connected to a low level voltage supply source for supplying a voltage less than the sustain voltage. The other terminal may be grounded. The low level voltage supply source may be a data voltage source for supplying a data signal to the address electrode.

A plasma display apparatus according to the embodiments of the present invention comprises a plasma display panel comprising a sustain electrode and an address electrode, and a driver for supplying a voltage of a sustain signal and a sustain bias voltage to the sustain electrode using one voltage source.

The driver may comprise a sustain voltage supply control unit for controlling the voltage of the sustain signal supplied to the sustain electrode, a bias voltage generating unit for generating the sustain bias voltage, and a bias voltage supply control unit for controlling the sustain bias voltage supplied to the sustain electrode.

The bias voltage generating unit may comprise a voltage storing unit for storing the voltage of the sustain signal, and a buffer unit linked with the voltage storing unit.

The bias voltage generating unit may comprise a voltage storing unit for storing the voltage of the sustain signal, a buffer unit linked with the voltage storing unit, and a voltage control unit for controlling a magnitude of the voltage stored in the voltage storing unit.

The magnitude of the voltage stored in the voltage storing unit substantially may equal to a difference between the voltage of the sustain signal and a voltage formed in the voltage control unit.

One terminal of the buffer unit may be commonly connected to one terminal of the voltage control unit and a low level voltage supply source for supplying a voltage less than the sustain voltage. The other terminal of the voltage control unit may be commonly connected to one terminal of the voltage storing unit and the other terminal of the bias voltage supply control unit.

Hereinafter, exemplary embodiments of the present invention will be described in detail with reference to the attached drawings.

FIG. 1 illustrates a plasma display apparatus according to one embodiment of the present invention.

Referring to FIG. 1, a plasma display apparatus according to one embodiment of the present invention comprises a plasma display panel 100 and a driver for supplying a predetermined driving voltage to electrodes of the plasma display panel 100. Preferably, the driver comprises a data driver 101, a scan driver 102 and a sustain driver 103.

The plasma display panel 100 comprises a front panel (not shown) and a rear panel (not shown) which are coalesced to each other at a regularly spaced distance. A plurality of electrodes, for example, a plurality of scan electrodes Y and a plurality of sustain electrodes Z are formed in the plasma display panel 100.

A structure of the plasma display panel 100 will be described in detail with reference to FIG. 2.

Figure 2:
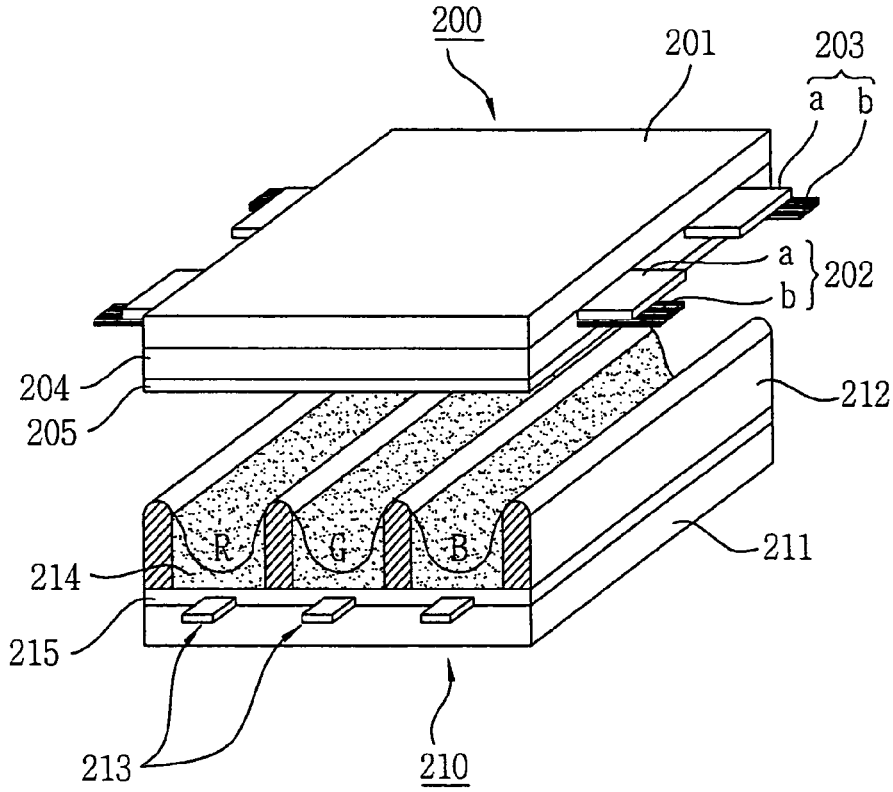
FIG. 2 illustrates one example of a structure of a plasma display panel in the plasma display apparatus according to one embodiment of the present invention.

FIG. 2 illustrates one example of a structure of a plasma display panel in the plasma display apparatus according to one embodiment of the present invention.

Referring to FIG. 2, the plasma display panel 100 comprises a front panel 200 and a rear panel 210 which are coupled in parallel to oppose to each other at a given distance therebetween. A plurality of scan electrodes 202, Y and a plurality of sustain electrodes 203, Z are formed in pairs on a front glass substrate 201 of the front panel 200 being a display surface, on which an image is displayed. A plurality of address electrodes 213, X are arranged on a rear glass substrate 211 of the rear panel 210 constituting a rear surface to intersect the scan electrodes 202, Y and the sustain electrodes 203, Z.

The scan electrodes 202, Y and the sustain electrodes 203, Z each comprise a transparent electrode "a" made of transparent indium-tin-oxide (ITO) material and a bus electrode "b" made of a metal material. The scan electrodes 202, Y and the sustain electrodes 203, Z generate a mutual discharge therebetween in one discharge cell and maintain emissions of discharge cells. The scan electrodes 202, Y and the sustain electrodes 203, Z are covered with one or more upper dielectric layers 204 for limiting a discharge current and providing insulation between the scan electrodes 202, Y and the sustain electrodes 203, Z. A protective layer 205 with a deposit of MgO is formed on an upper surface of the upper dielectric layer 204 to facilitate discharge conditions.

A plurality of stripe-type (or well-type) barrier ribs 212 are formed in parallel on the rear glass substrate 211 of the rear panel 210 to form a plurality of discharge spaces, that is, a plurality of discharge cells. The plurality of address electrodes 213, X are arranged in parallel with the barrier ribs 212 to perform an address discharge and generate vacuum ultraviolet rays.

Red (R), green (G) and blue (B) phosphors 214 are coated on an upper surface of the rear glass substrate 211 to emit visible light for displaying an image during the generation of the address discharge. A lower dielectric layer 215 is formed between the address electrodes 213, X and the phosphors 214 to protect the address electrodes 213, X.

Only an example of the plasma display panel applicable to the embodiment of the present invention was illustrated in FIG. 2. However, the embodiment of the present invention is not limited to the structure of the plasma display panel illustrated in FIG. 2.

For example, in FIG. 2, the scan electrodes 202, Y and the sustain electrodes 203, Z each comprise the transparent electrode "a" and the bus electrode "b". However, at least one of the scan electrodes 202, Y and the sustain electrodes 203, Z may comprise either the bus electrode "b" or the transparent electrode "a".

Further, the structure of the plasma display panel, in which the front panel 200 comprises the scan electrodes 202, Y and the sustain electrodes 203, Z and the rear panel 210 comprises the address electrodes 213, X, was illustrated in FIG. 2. However, the front panel 200 may comprise all of the scan electrodes 202, Y, the sustain electrodes 203, Z, and the address electrodes 213, X. At least one of the scan electrodes 202, Y, the sustain electrodes 203, Z, and the address electrodes 213, X may be formed on the barrier rib 212.

Considering the structure of the plasma display panel 100 of FIG. 2, the plasma display panel 100 applicable to the embodiments of the present invention has only to comprise the san electrodes 202, Y, the sustain electrodes 203, Z, and the address electrodes 210, X. The plasma display panel 100 may have various structures except the above-described structural characteristic.

The description of FIG. 2 is completed, and the description of FIG. 1 succeeds constantly.

The data driver 101 supplies a voltage of a data signal Vd to the address electrode X of the plasma display panel 100 in an address period such that the address electrode X is driven.

The sustain driver 103 supplies a voltage Vs of a sustain signal in a sustain period for displaying an image, and a sustain bias voltage in the address period to the sustain electrode Z of the plasma display panel 100 such that the sustain electrode Z is driven.

The scan driver 102 supplies a voltage of a falling signal, that is, a set-down voltage in a reset period, a voltage of a scan signal of a negative polarity direction in the address period, and a voltage Vs of a sustain signal in the sustain period, to the scan electrode Y of the plasma display panel 100 such that the scan electrode Y is driven.

The scan driver 102 supplies the voltage Vs of the sustain signal, the voltage of the scan signal of the negative polarity direction, and the set-down voltage to the scan electrode Y using one voltage source.

It is preferable that one voltage source for generating all of the voltage Vs of the sustain signal, the voltage of the scan signal of the negative polarity direction, and the set-down voltage is a sustain voltage source for supplying the voltage Vs of the sustain signal.

A structure of the scan driver 102 will be described in detail with reference to FIG. 3.

Figure 3:
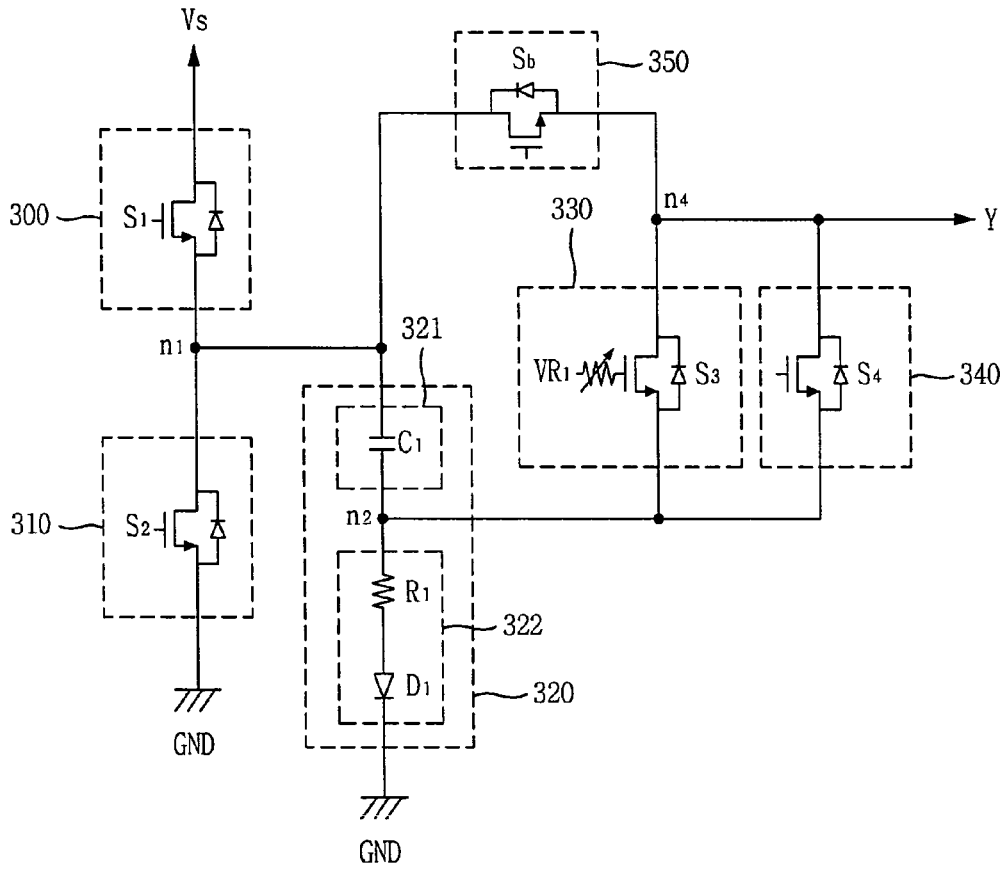
FIG. 3 illustrates a structure of a scan driver.

FIG. 3 illustrates a structure of a scan driver.

Referring to FIG. 3, the scan driver of the plasma display apparatus according to one embodiment of the present invention comprises a sustain voltage supply control unit 300, a ground voltage supply control unit 310, a negative polarity scan voltage generating unit 320, a falling signal supply control unit 330, a scan voltage supply control unit 340, and a blocking unit 350.

The sustain voltage supply control unit 300 comprises a sustain voltage supply control switch S1. The sustain voltage supply control unit 300 controls the supply of the voltage Vs of the sustain signal to the scan electrode Y in response to a switching operation of the sustain voltage supply control switch S1.

The ground voltage supply control unit 310 comprises a ground voltage supply control switch S2. The ground voltage supply control unit 310 controls the supply of a ground level voltage GND to the scan electrode Y in response to a switching operation of the ground voltage supply control switch S2.

The negative polarity scan voltage generating unit 320 generates a voltage −Vy of a scan signal of a negative polarity direction having a polarity direction opposite a polarity direction of the voltage Vs of the sustain signal, using the voltage Vs of the sustain signal supplied under the control of the sustain voltage supply control unit 300 and the ground level voltage GND supplied under the control of the ground voltage supply control unit 310.

The scan voltage supply control unit 340 comprises a scan voltage supply control switch S4. The scan voltage supply control unit 340 controls the supply of the voltage −Vy of the scan signal of the negative polarity direction to the scan electrode Y in response to a switching operation of the scan voltage supply control switch S4.

The falling signal supply control unit 330 comprises a falling signal supply control switch S3 and a first variable resistance VR1 connected to a gate terminal of the falling signal supply control switch S3.

The blocking unit 350 comprises a reverse blocking switch Sb. The blocking unit 350 comprises an inverse current flowing from the sustain voltage supply control unit 300 or the ground voltage supply control unit 310 to the negative polarity scan voltage generating unit 320 or the falling signal supply control unit 330, using the reverse blocking switch Sb.

The falling signal supply control unit 330 generates a falling signal with the voltage −Vy of the scan signal of the negative polarity direction. More specifically, when the falling signal supply control switch S3 is turned on, the falling signal with a gradually falling voltage is supplied by controlling the channel width of the falling signal supply control switch S3 using the first variable resistance VR1.

The falling signal supply control unit 330 controls the supply of the falling signal to the scan electrode Y.

The negative polarity scan voltage generating unit 320 for generating the voltage −Vy of the scan signal of the negative polarity direction supplied to the falling signal supply control unit 330 and the scan voltage supply control unit 340 will be described in detail below.

The negative polarity scan voltage generating unit 320 comprises a voltage storing unit 321 and a buffer unit 322.

The voltage storing unit 321 comprises a first capacitor C1 for storing a part or all of the voltage Vs of the sustain signal supplied under the control of the sustain voltage supply control unit 300. The part or all of the voltage Vs of the sustain signal is stored in the first capacitor C1.

For example, when a magnitude of the voltage Vs of the sustain signal is 200V, a maximum voltage of 200V is stored in the first capacitor C1.

When a voltage of the buffer unit 322, which will be described below, is 0V, a voltage of 200V is stored in the first capacitor C1.

A magnitude of a voltage stored in the first capacitor C1 equals to the voltage −Vy of the scan signal of the negative polarity direction supplied to the falling signal supply control unit 330 and the scan voltage supply control unit 340.

One terminal of the voltage storing unit 321 is commonly connected to one terminal of the sustain voltage supply control unit 300, one terminal of the ground voltage supply control unit 310, and one terminal of the blocking unit 350 at a first node n1.

The other terminal of the voltage storing unit 321 is commonly connected to one terminal of the buffer unit 322 and one terminal of the scan voltage supply control unit 340 at a second node n2.

The other terminal of the blocking unit 350 is commonly connected to the other terminal of the scan voltage supply control unit 340 and the other terminal of the falling signal supply control unit 330.

The buffer unit 322 is linked to the voltage storing unit 321. More specifically, the buffer unit 322 stabilizes an operation of the voltage storing unit 321. The buffer unit 322 comprises a load reduction resistance R1 and a reverse blocking diode D1.

The load reduction resistance R1 and the reverse blocking diode D1 are connected in series at a connection terminal of one terminal of the scan voltage supply control unit 340, one terminal of the falling signal supply control unit 330, and the other terminal of the voltage storing unit 321, that is, between the second node n2 and the ground.

A cathode of the reverse blocking diode D1 is connected to the ground. An anode of the reverse blocking diode D1 is connected to a connection terminal of one terminal of the scan voltage supply control unit 340, one terminal of the falling signal supply control unit 330, and the other terminal of the voltage storing unit 321, that is, to the second node n2.

It is preferable that one terminal of the buffer unit 322 is commonly connected to the connection terminal of one terminal of the scan voltage supply control unit 340, one terminal of the falling signal supply control unit 330, and the other terminal of the voltage storing unit 321, that is, to the second node n2, and the other terminal of the buffer unit 322 is grounded.

In FIG. 3, the structure of the scan driver for supplying the voltage Vs of the sustain signal and the voltage of the falling signal to the scan electrode Y has been described.

It is possible to construct the scan driver for supplying not only the voltage −Vy of the scan signal of the negative polarity direction and the voltage of the falling signal but also a rising signal with a gradually rising voltage, a scan reference voltage Vsc, and the like, to the scan electrode Y by adding predetermined elements to the scan driver of the FIG. 3.

The scan driver will be described with reference to FIGS. 4*a* and 4*b*.

Figure 4A:
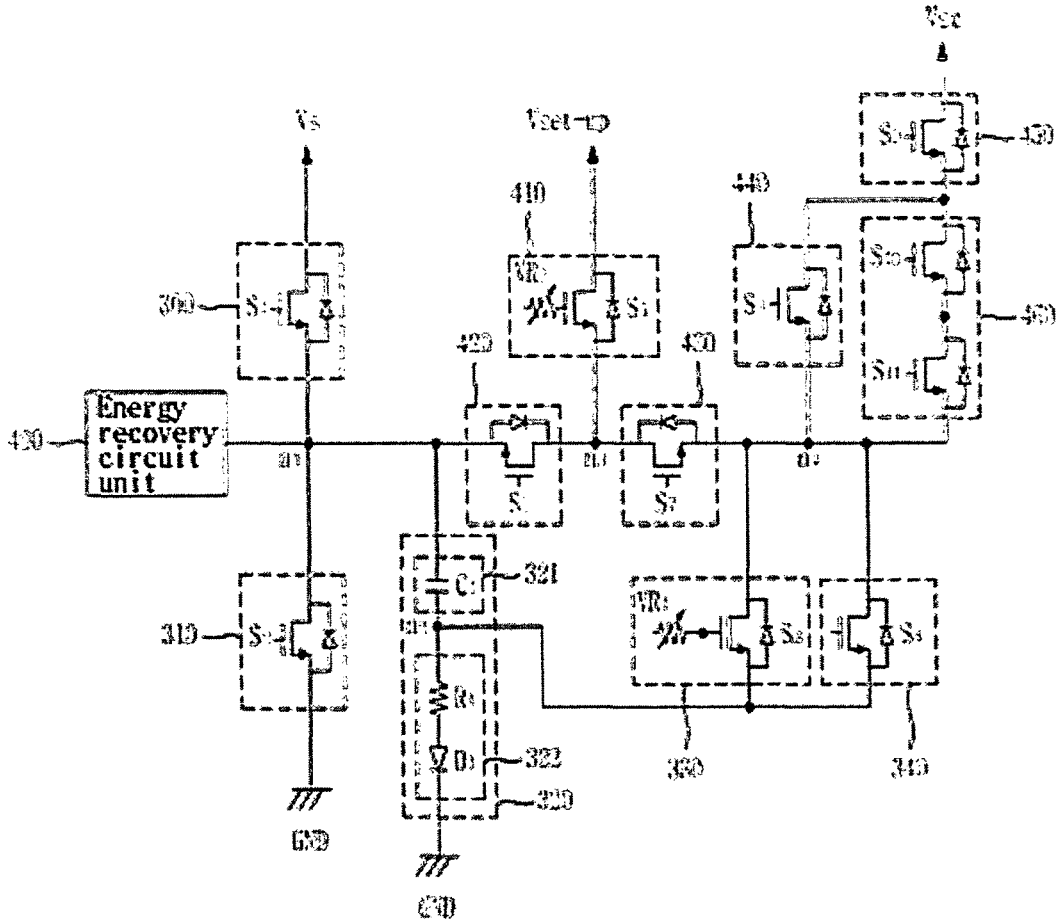
FIGS. 4*a* and 4*b* illustrate an extended structure of the scan driver of the plasma display apparatus according to one embodiment of the present invention.
Figure 4B:
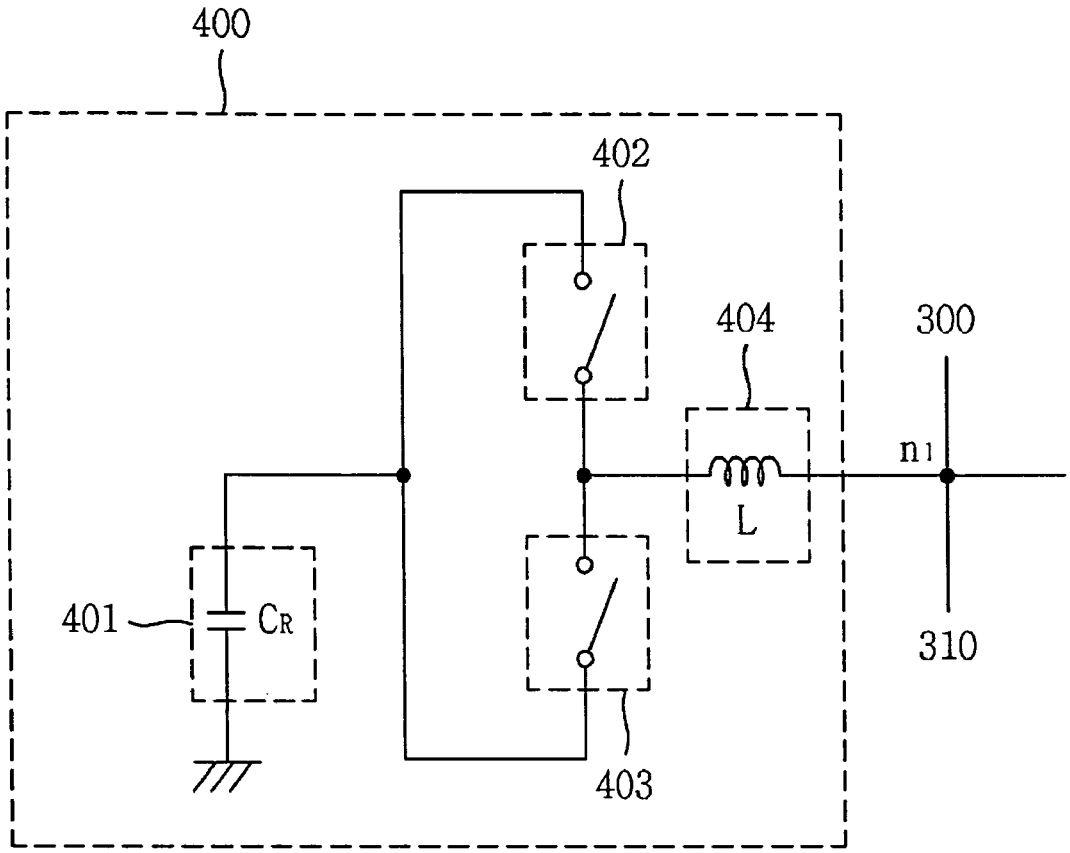

FIGS. 4*a* and 4*b* illustrate an extended structure of a scan driver of the plasma display apparatus according to one embodiment of the present invention.

Referring to FIG. 4*a*, the scan driver of the plasma display apparatus according to one embodiment of the present invention comprises the sustain voltage supply control unit 300, the ground voltage supply control unit 310, the negative polarity scan voltage generating unit 320, the falling signal supply control unit 330, the scan voltage supply control unit 340, and further comprises an energy recovery circuit unit 400, a rising signal supply control unit 410, a first blocking switch unit 420, a second blocking switch unit 430, a current path selecting unit 440, a scan reference voltage supply control unit 450, and a scan drive integrated circuit (IC) unit 460.

The rising signal supply control unit 410 comprises a rising signal supply control switch S5 and a second variable resistance VR2 connected to a gate terminal of the rising signal supply control switch S5.

The rising signal supply control unit 410 generates a rising signal which gradually rises to a setup voltage Vsetup supplied by a setup voltage source. More specifically, when the rising signal supply control switch S5 is turned on, the rising signal supply control unit 410 generates a rising falling signal with a gradually rising voltage by controlling the channel width of the rising signal supply control switch S5 using the second variable resistance VR2.

The rising signal supply control unit 410 controls the supply of the rising signal to the scan electrode Y. For example, the rising signal supply control unit 410 controls the supply of the voltage of the rising signal, that is, the setup voltage Vsetup to the scan electrode Y in the reset period.

The first blocking switch unit 420 comprises a first blocking switch S6. When a voltage at a third node n3 or a voltage at a fourth node n4 is a relatively high voltage level in the off-state of the first blocking switch S6, the first blocking switch unit 420 prevents the voltage at the third node n3 or the voltage at the fourth node n4 from being a ground level voltage.

The second blocking switch unit 430 comprises a second blocking switch S7. When a voltage at a first node n1 or the voltage at the third node n3 is a relatively high voltage level in the off-state of the second blocking switch S7, the second blocking switch unit 430 prevents the voltage at the first node n1 or the voltage at the third node n3 from being the voltage at the fourth node n4.

The second blocking switch unit 430 has a function equal to the blocking unit 350 of FIG. 3. Only, in FIG. 4, the blocking unit 350 of FIG. 3 is called the second blocking switch unit 430 for convenience of the explanation.

When the voltage at the first node n1 or the voltage at the third node n3 has a relatively higher voltage than the voltage at the fourth node n4 in the on-state of the second blocking switch S7, it is a strong likelihood that the voltage at the first node n1 or the voltage at the third node n3 is the voltage at the fourth node n4.

The scan reference voltage supply control unit 450 comprises a scan reference voltage supply control switch S9. The scan reference voltage supply control unit 450 controls the supply of a scan reference voltage Vsc supplied by a scan reference voltage source to the scan electrode Y.

The scan drive IC unit 460 comprises a top switch S10 and a bottom switch S11. The scan drive IC unit 460 supplies the voltage received to the scan drive IC unit 460 to the scan electrode Y through a switching operation thereof.

For example, when the scan reference voltage supply control unit 450 supplies the scan reference voltage Vsc to the scan electrode Y, the top switch S10 of the scan drive IC unit 460 is turned on such that the scan reference voltage Vsc is supplied to the scan electrode Y.

The current path selecting unit 440 comprises a current path selecting switch S8. The current path selecting unit 440 forms a supply path of a voltage to the scan electrode Y or a recovery path of a voltage from the scan electrode Y through a switching operation thereof.

For example, the current path selecting switch S8 of the current path selecting unit 440 is turned on when the energy recovery circuit unit 400 recovers a reactive energy of the scan electrode Y of the plasma display panel, such that a recovery path of the reactive energy recovered to the energy recovery circuit unit 400 through the top switch S10 of the scan drive IC unit 460 and the current path selecting switch S8 is formed The energy recovery circuit unit 400 supplies the energy previously stored in the energy recovery circuit unit 400 to the scan electrode Y of the plasma display panel, and recovers the reactive energy of the scan electrode Y of the plasma display panel.

A structure of the energy recovery circuit unit 400 illustrated in a block form in FIG. 4*a* will be described with reference to FIG. 4*b*.

Referring to FIG. 4*b*, the energy recovery circuit unit 400 comprises an energy storing unit 401, an energy supply control unit 402, an energy recovery control unit 403 and an inductor unit 404.

When the energy supply control unit 402 is turned on the assumption that a voltage of ½Vs is stored in the energy storing unit 401 in an energy supply step, energy stored in an energy storing capacitor $C_R$ of the energy storing unit 401 passes the energy supply control unit 402 and the inductor unit 404. Further, the energy passes the first node n1 and rises up to a voltage of Vs by LC resonance of inductance of the inductor unit 404 and capacitance of the panel.

Next, when the energy recovery control unit 403 is turned on in an energy recovery step, the reactive energy of the panel is stored in the energy storing unit 401 through LC resonance of the inductor unit 404.

Only one example of the energy recovery circuit unit 400 applicable to the scan driver of the plasma display apparatus according to one embodiment of the present invention is illustrated in FIG. 4*b*. The embodiment of the present invention is not limited to the energy recovery circuit unit 400 of FIG. 4*b*.

For example, one inductor unit was commonly used in the energy supply path and the energy recovery path in FIG. 4*b*. However, different inductor units of different sizes may be used in the energy supply path and the energy recovery path, respectively.

An operation of the scan driver of the plasma display apparatus according to one embodiment of the present invention will be described in detail with reference to FIG. 5.

Figure 5:
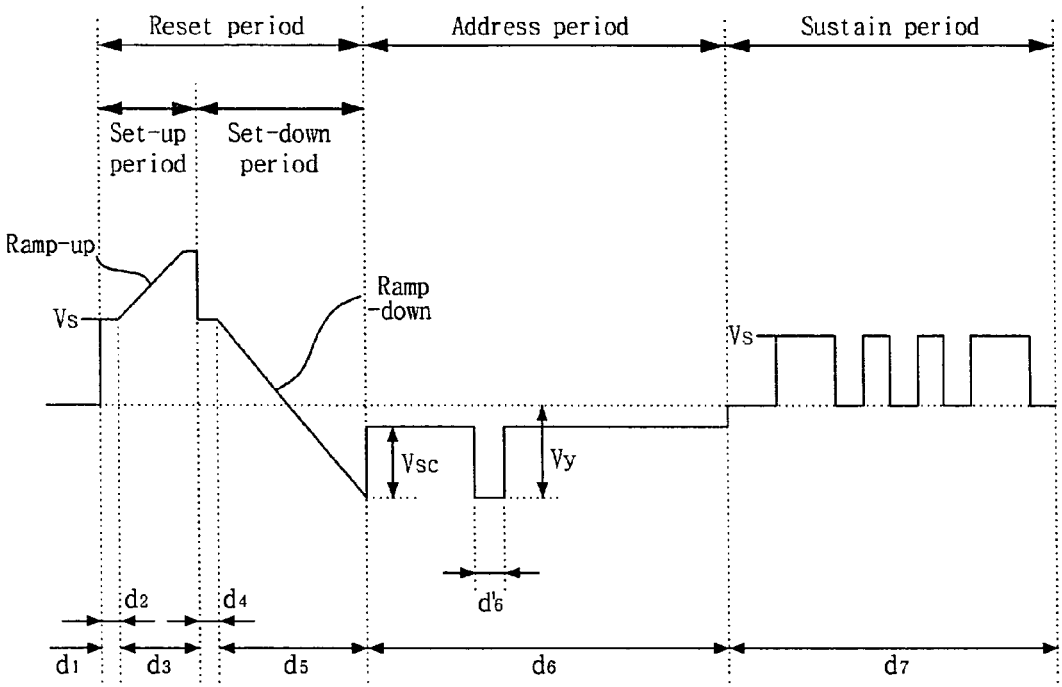
FIG. 5 illustrates an operation of the scan driver of the plasma display apparatus according to one embodiment of the present invention.

FIG. 5 illustrates an operation of a scan driver of the plasma display apparatus according to one embodiment of the present invention.

An example of a driving waveform generated by the scan driver of the plasma display apparatus according to one embodiment of the present invention is illustrated in FIG. 5.

When the ground voltage supply control switch S2 of the ground voltage supply control unit 310 of FIG. 4*a*, the first blocking switch S6 of the first blocking unit 420, the second blocking switch S7 of the second blocking unit 430, and the current path selecting switch S8 of the current path selecting unit 440 are turned on, a ground level voltage is supplied to the scan electrode Y of the plasma display panel. As a result, a voltage of the scan electrode Y equals to a ground level voltage in a period d1 of FIG. 5.

Next, when the ground voltage supply control switch S2 is turned off and the sustain voltage supply control switch S1 of the sustain voltage supply control unit 300 is turned on, the voltage Vs of the sustain signal is supplied to the scan electrode Y of the plasma display panel. As a result, the voltage of the scan electrode Y equals to the voltage Vs of the sustain signal in a period d2 of FIG. 5.

Next, the first blocking switch S6 is turned off and the rising signal supply control switch S5 of the rising signal supply control unit 410 is turned on, a voltage of a rising signal Ramp-up with a gradually rising voltage, that is, a setup voltage Vsetup is supplied to the scan electrode Y of the plasma display panel. As a result, the voltage of the scan electrode Y gradually rises from the voltage Vs of the sustain signal to a sum of the voltage Vs of the sustain signal and the setup voltage Vsetup in a period d3 of FIG. 5.

Next, when the rising signal supply control switch S5 is turned off in the on-state of the sustain voltage supply control switch S1 of the sustain voltage supply control unit 300 and the first blocking switch S6 is turned on, the voltage Vs of the sustain signal is supplied to the scan electrode Y of the plasma display panel. As a result, the voltage of the scan electrode Y falls to the voltage Vs of the sustain signal in a period d4 of FIG. 5.

Next, when the sustain voltage supply control switch S1 and the second blocking switch S7 are turned off and the ground voltage supply control switch S2 and the falling signal supply control switch S3 of the falling signal supply control unit 330 are turned on, a voltage of a falling signal Ramp-down with a gradually falling voltage, that is, a set-down voltage Vset-down is supplied to the scan electrode Y of the plasma display panel. As a result, the voltage of the scan electrode Y gradually falls from the voltage Vs of the sustain signal to a predetermined voltage less than the voltage Vs of the sustain signal in a period d5 of FIG. 5.

The voltage of the scan electrode Y in the period d5 may fall up to the voltage −Vy of the scan signal of the negative polarity direction.

A reset period comprises the periods d2 to d5. More specifically, a setup period comprises the periods d2 and d3 and a set-down period comprises the periods d4 and d5.

In the setup period of the reset period, that is, in the periods d2 and d3 of FIG. 5, the voltage of the rising signal Ramp-up is supplied to the scan electrode Y, thereby generating a weak dark discharge within discharge cells of the whole screen.

The weak dark discharge is called a setup discharge. The setup discharge uniformly accumulates wall charges within discharge cells.

In the set-down period of the reset period, that is, in the periods d4 and d5 of FIG. 5, after the supply of the rising signal Ramp-up, the voltage of the falling signal Ramp-down which falls from the voltage Vs of the sustain signal lower than the voltage of the rising signal Ramp-up to a specific level voltage of a ground level voltage or less is supplied to the scan electrodes Y, thereby generating a weak erasure discharge within the discharge cells. The weak erase discharge sufficiently erases the wall charges excessively accumulated within the discharge cells.

The weak erase discharge is called a set-down discharge. By performing the set-down discharge, the wall charges uniformly remain within the discharge cells to the degree that there is the generation of a stable address discharge.

In the period d5, the negative polarity scan voltage generating unit 320 generates the voltage of the falling signal using the voltage Vs of the sustain signal supplied through the sustain voltage supply control unit 300. This operation of the negative polarity scan voltage generating unit 320 will be described in detail with reference to FIGS. 6*a* and 6*b*.

Figure 6A:
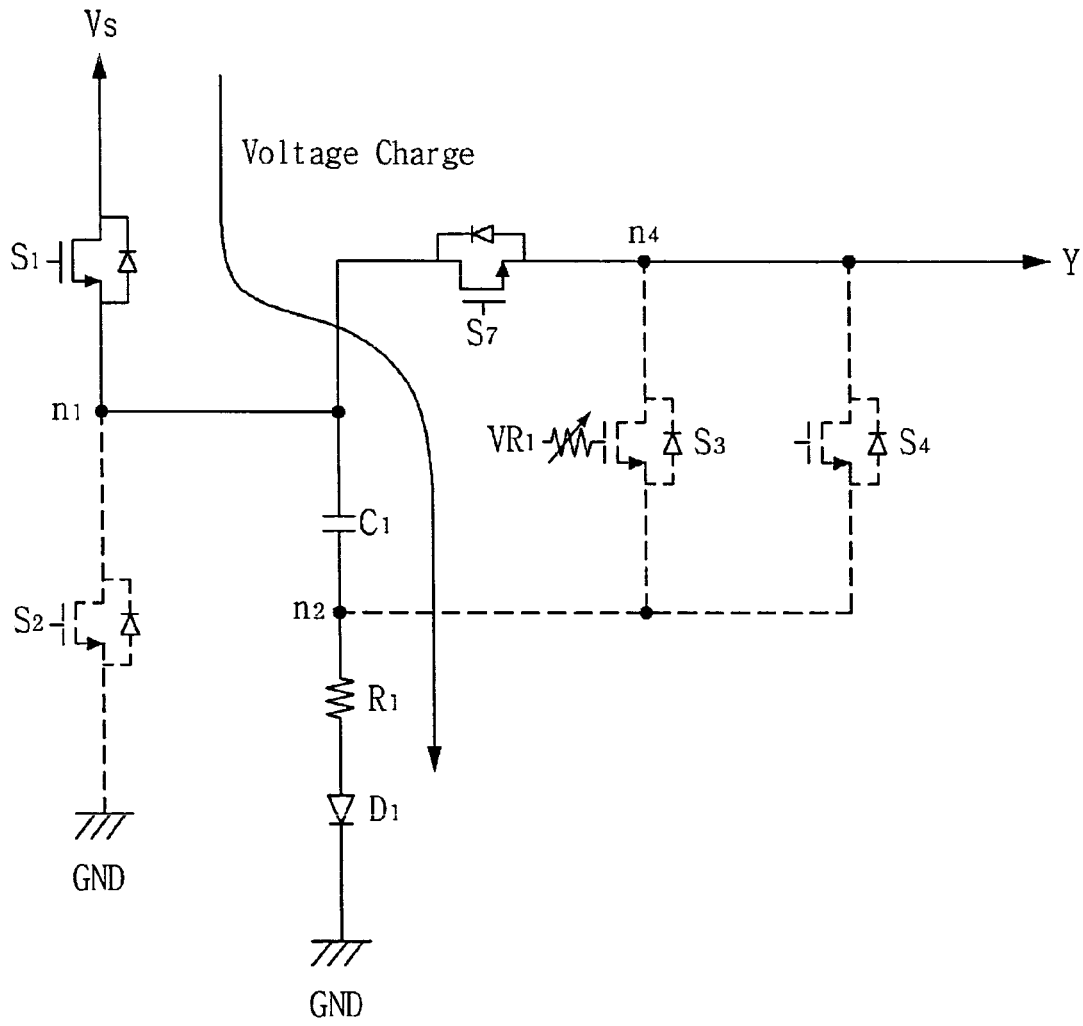
FIGS. 6*a* and 6*b* illustrate a method for generating a voltage of a scan signal of a negative polarity direction in a negative polarity scan voltage generating unit.
Figure 6B:
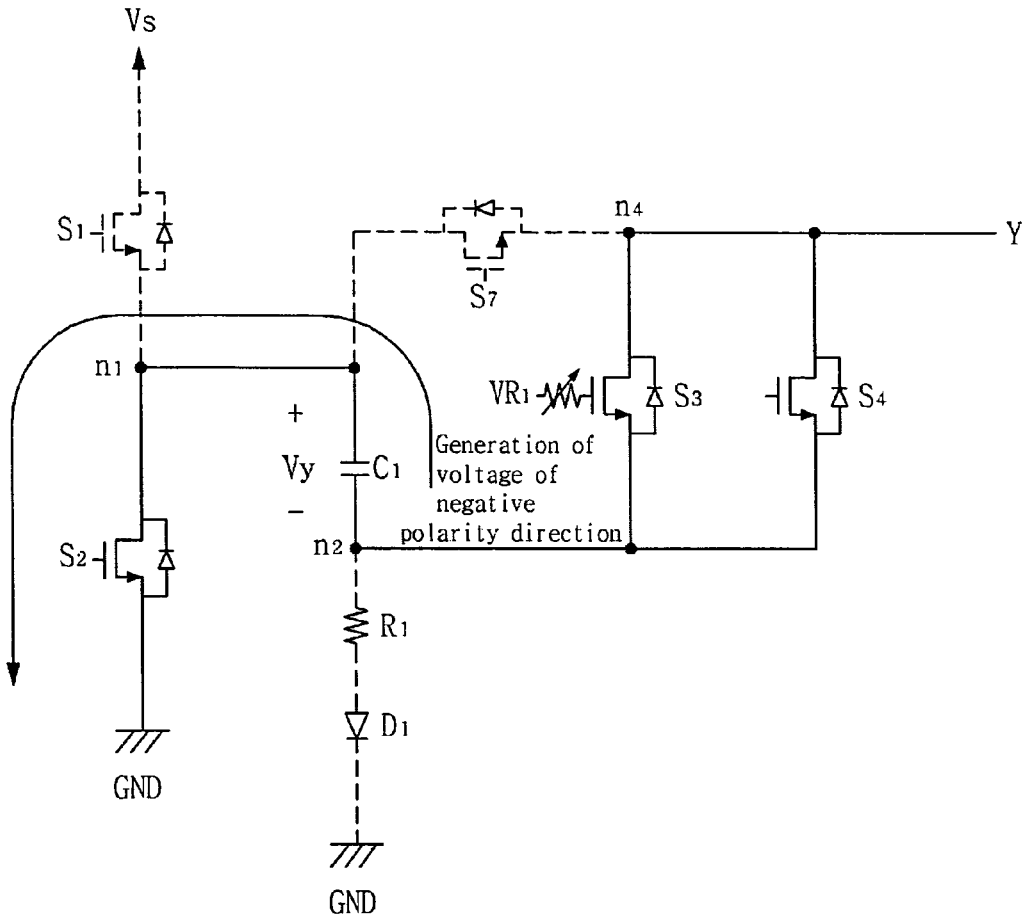

FIGS. 6*a* and 6*b* illustrate a method for generating a voltage of a scan signal of a negative polarity direction in a negative polarity scan voltage generating unit.

Referring to FIG. 6*a*, the sustain voltage supply control switch S1 is turned on in the off-state of the ground voltage supply control switch S2.

The voltage Vs of the sustain signal supplied by the sustain voltage source passes the ground voltage supply control switch S2 and starts to be charged to the first capacitor C1 of the voltage storing unit 321 of the negative polarity scan voltage generating unit 320.

The load reduction resistance R1 of the buffer unit 322 prevents the flow of an excessive amount of current from the sustain voltage source to the ground.

A magnitude of the voltage stored in the first capacitor C1 of the voltage storing unit 321 approximately equals to a difference between the voltage Vs of the sustain signal and the voltage of the buffer unit 322.

In other words, a sum of the voltage of the buffer unit 322 and the voltage stored in the first capacitor C1 of the voltage storing unit 321 approximately equals to the voltage Vs of the sustain signal.

Suppose that a resistance of the load reduction resistance R1 is a negligible value and the reverse blocking diode D1 is an ideal diode, the voltage stored in the first capacitor C1 of the voltage storing unit 321 equals to the voltage Vs of the sustain signal.

While the voltage is stored in the first capacitor C1 of the voltage storing unit 321, the second blocking switch S7 of the second blocking switch unit 430 may be turned on or off.

Preferably, while the voltage is stored in the first capacitor C1 of the voltage storing unit 321, the second blocking switch S7 of the second blocking switch unit 430 is turned on.

Accordingly, a process for supplying the voltage Vs of the sustain signal to the scan electrode Y of the plasma display panel and a process for charging the voltage of the scan signal of the negative polarity direction to the first capacitor C1 of the voltage storing unit 321 are integrated into one process.

Referring to FIG. 6*b*, the ground voltage supply control switch S2 is turned on, and the sustain voltage supply control switch S1 is turned off. Further, the second blocking switch S7 is turned off.

Thus, the reverse blocking diode D1 of the buffer unit 322 blocks the inverse current flowing from the ground GND to the buffer unit 322. A current path passing through the first node n1, the ground voltage supply control switch S2 and the ground GND is formed. Accordingly, the voltage stored in the first capacitor C1 is discharged to the ground GND through the ground voltage supply control switch S2.

A scan voltage Vy is stored in the voltage storing unit 321 whose one terminal is connected to a positive direction and the other terminal is connected to a negative direction.

Accordingly, the voltage stored in the voltage storing unit 321 is a negative scan voltage −Vy in a viewpoint of the falling signal supply control unit 330 and the scan voltage supply control unit 340.

Consequently, the voltage −Vy of the scan signal of the negative polarity direction is supplied to the falling signal supply control unit 330 and the scan voltage supply control unit 340.

As described above, the voltage −Vy of the scan signal of the negative polarity direction and the voltage of the falling signal are supplied using the voltage Vs of the sustain signal for supplying a sustain signal supplied to the scan electrode Y during a sustain period.

Accordingly, separate voltage sources for generating the voltage −Vy of the scan signal of the negative polarity direction and the voltage of the falling signal are not required. As a result, the fabricating cost of the plasma display apparatus decreases.

The description of FIGS. 6*a* and 6*b* is completed, and the description of FIG. 5 succeeds constantly.

Subsequent to the periods d2 to d5, when the scan reference voltage supply control switch S9 of the scan reference voltage supply control unit 450 and the top switch S10 of the scan drive IC unit 460 are turned on, the scan reference voltage Vsc is supplied to the scan electrode Y of the plasma display panel.

In a period d6, the voltage of the scan electrode Y rises from an end of the voltage of the falling signal, that is, an end of the set-down voltage by a magnitude of the scan reference voltage Vsc.

When the scan voltage supply control switch S4 of the scan voltage supply control unit 340 and the ground voltage supply control switch S2 of the ground voltage supply control unit 310 are turned on at a previously designated time point during the period d6, the voltage −Vy of the scan signal of the negative polarity direction is supplied to the scan electrode Y of the plasma display panel.

In a period d'6 of FIG. 5, the voltage of the scan electrode Y falls from the scan reference voltage Vsc to the voltage −Vy of the scan signal of the negative polarity direction.

A magnitude of the voltage −Vy of the scan signal of the negative polarity direction approximately equals to a magnitude of the voltage stored in the voltage storing unit 321.

For example, suppose that the magnitude of the voltage stored in the voltage storing unit 321 approximately equals to the voltage Vs of the sustain signal, the magnitude of the voltage −Vy of the scan signal of the negative polarity direction approximately equals to the voltage Vs of the sustain signal.

Since the process for generating the voltage −Vy of the scan signal of the negative polarity direction supplied to the scan electrode Y in the period d'6 was described with reference to FIGS. 6*a* and 6*b*, a description thereof is omitted.

The period d6 comprising the period d'6 is called an address period. In the address period, the voltage −Vy of the scan signal of the negative polarity direction falling from the scan reference voltage Vsc is sequentially supplied to the scan electrodes Y. At the same time, a data signal of a positive polarity direction synchronized with the scan signal is supplied to the address electrode X.

While the voltage difference between the scan signal and the data signal is added to the wall charges produced during the reset period, the address discharge is generated within the discharge cells to which the data signal is supplied.

The wall charges necessary for a discharge when applying the voltage Vs of the sustain signal are formed within the discharge cells selected by performing the address discharge.

In a period d7 subsequent to the period d6, the first blocking switch S6, the second blocking switch S7 and the current path selecting switch S8 are turned on, and the sustain voltage supply control switch S1 and the ground voltage supply control switch S2 are alternately turned off.

When the energy recovery circuit unit 400 of FIG. 4*b* alternately performs the energy supply operation and the energy recovery operation, the voltage of the scan electrode Y rises to the voltage Vs of the sustain signal and then falls to the ground level voltage. That is, the sustain signal is supplied to the scan electrode Y.

Since the sustain voltage supply control unit 300 and the second blocking switch unit 430 are turned on in the period d7, as illustrated in FIG. 6*a*, the voltage −Vy of the scan signal of the negative polarity direction is charged to the first capacitor C1 of the voltage storing unit 321.

Another structure of the scan driver in the plasma display apparatus according to one embodiment of the present invention will be described in detail with reference to FIG. 7.

Figure 7:
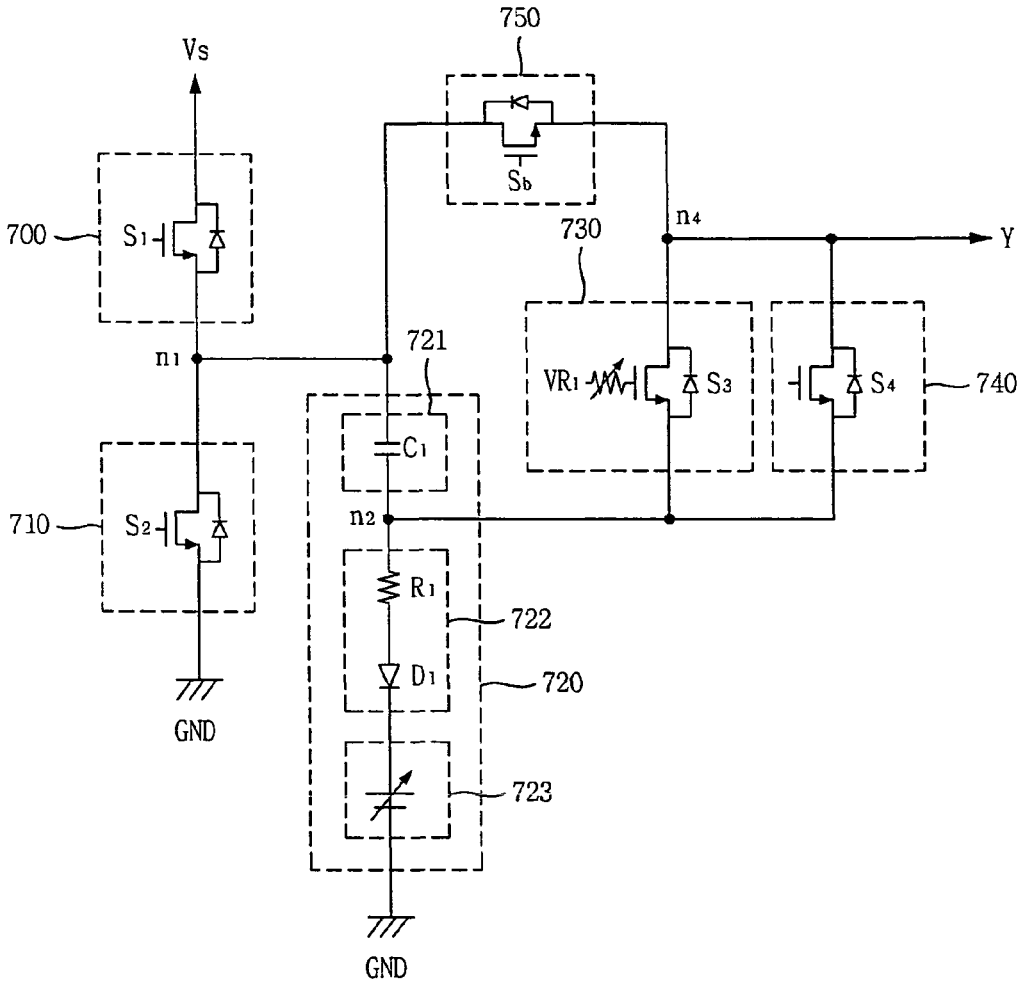
FIG. 7 illustrates another structure of the scan driver in the plasma display apparatus according to one embodiment of the present invention.

FIG. 7 illustrates another structure of the scan driver in the plasma display apparatus according to one embodiment of the present invention.

Referring to FIG. 7, the scan driver of the plasma display apparatus according to one embodiment of the present invention comprises a sustain voltage supply control unit 700, a ground voltage supply control unit 710, a negative polarity scan voltage generating unit 720, a falling signal supply control unit 730, a scan voltage supply control unit 740, and a blocking unit 750.

The negative polarity scan voltage generating unit 720 comprises a voltage storing unit 721, a buffer unit 722 and a voltage control unit 723.

The voltage storing unit 721 stores a part of a voltage Vs of a sustain signal supplied under the control of the sustain voltage supply control unit 700.

The buffer unit 722 is linked with the voltage storing unit 721. More specifically, the buffer unit 722 stabilizes an operation of the voltage storing unit 721.

The voltage control unit 723 controls a magnitude of the voltage stored in the voltage storing unit 721.

A voltage subtracting a voltage of the voltage control unit 723 from the voltage Vs of the sustain signal is stored in the voltage storing unit 721. That is, a magnitude of a voltage stored in the voltage storing unit 721 approximately equals to a difference between the voltage Vs of the sustain signal and the voltage stored in the voltage control unit 723.

Consequently, the voltage control unit 723 controls the magnitude of the voltage stored in the voltage storing unit 721.

Since the sustain voltage supply control unit 700, the ground voltage supply control unit 710, the falling signal supply control unit 730, the scan voltage supply control unit 740 and the blocking unit 750 are illustrated and described in FIG. 3 or 4*a*, a description thereof is omitted.

The negative polarity scan voltage generating unit 720 generates a voltage −Vy of a scan signal of a negative polarity direction having a polarity direction opposite a polarity direction of the voltage Vs of the sustain signal, using the voltage Vs of the sustain signal supplied under the control of the sustain voltage supply control unit 700 and a ground level voltage GND supplied under the control of the ground voltage supply control unit 710.

The voltage storing unit 721 comprises a first capacitor C1 for storing a part of the voltage Vs of the sustain signal supplied under the control of the sustain voltage supply control unit 700.

For example, when a magnitude of the voltage Vs of the sustain signal is set to 200V and a magnitude of the voltage stored in the voltage control unit 723 is set to 50V, a maximum voltage of 150V is stored in the first capacitor C1.

One terminal of the voltage storing unit 721 is commonly connected to one terminals of the sustain voltage supply control unit 700, the ground voltage supply control unit 710, and the blocking unit 750 at a first node n1.

The other terminal of the voltage storing unit 721 is commonly connected to one terminal of the buffer unit 722, one terminal of the scan voltage supply control unit 740, and one terminal of the falling signal supply control unit 730 at a second node n2.

The other terminal of the scan voltage supply control unit 740 and the other terminal of the falling signal supply control unit 730 are commonly connected to the other terminal of the blocking unit 750.

One terminal of the buffer unit 722 is commonly connected to a connection terminal of one terminal of the scan voltage supply control unit 740, one terminal of the falling signal supply control unit 730, and the other terminal of the voltage storing unit 721, that is, to the second node n2. The other terminal of the buffer unit 722 is connected to one terminal of the voltage control unit 723.

It is preferable that one terminal of the voltage control unit 723 is connected to the other terminal of the buffer unit 722, and the other terminal of the voltage control unit 723 is grounded.

As previously illustrated in FIGS. 4*a* and 4*b*, it is possible to construct the scan driver for supplying not only the voltage −Vy of the scan signal of the negative polarity direction, the voltage Vs of the sustain signal and the voltage of the falling signal but also a voltage of a rising signal, a scan reference voltage Vsc, and the like, to the scan electrode Y by adding predetermined elements to the scan driver of the FIG. 7.

Since the above-described structure was illustrated with reference to FIGS. 4*a* and 4*b*, a description thereof is omitted.

An operation of the scan driver in the plasma display apparatus according to the embodiment of the present invention will be described in detail with reference to FIG. 8.

Figure 8:
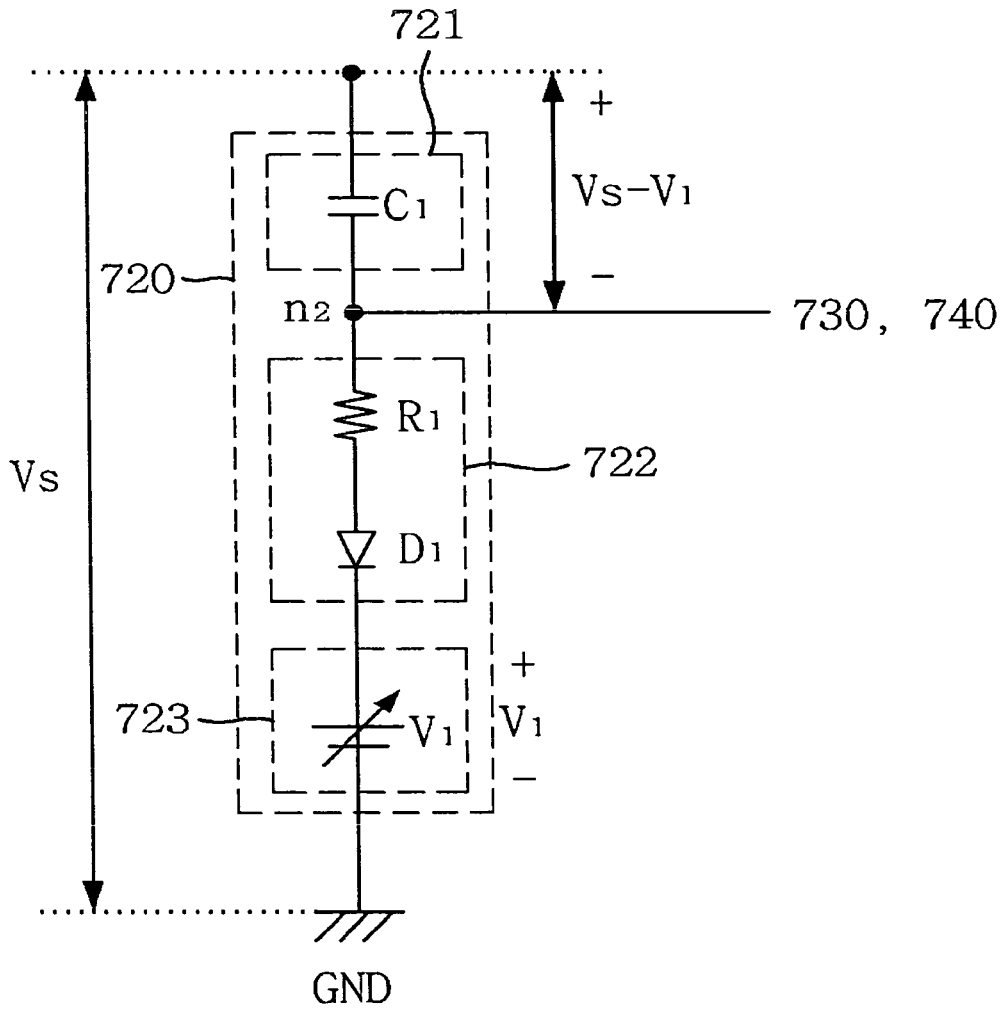
FIG. 8 illustrates an operation of a negative polarity scan voltage generating unit in the scan driver of FIG. 7.

FIG. 8 illustrates an operation of a negative polarity scan voltage generating unit in the scan driver of FIG. 7.

Referring to FIG. 8, when a magnitude of the total voltage stored in the negative polarity scan voltage generating unit 720 equals to the voltage Vs of the sustain signal and the voltage stored in the voltage control unit 723 equals to V1, a magnitude of the voltage stored in the voltage storing unit 721 approximately equals to a voltage of (Vs−V1). At this time, the voltage stored in the buffer unit 722 was set to 0V.

The voltage of (Vs−V1) stored in the voltage storing unit 721 is reversed to a voltage of −(Vs−V1) through the process illustrated in FIGS. 6*a* and 6*b*. The reversed voltage of −(Vs−

V1) is supplied to the falling signal supply control unit 730 or the scan voltage supply control unit 740.

The magnitude of the voltage −Vy of the scan signal of the negative polarity direction supplied to the falling signal supply control unit or the scan voltage supply control unit in FIG. 7 is less than the magnitude of the voltage −Vy of the scan signal of the negative polarity direction in FIG. 3.

By controlling the magnitude of the voltage −Vy of the scan signal of the negative polarity direction, an optimum discharge environment can be provided under the various conditions.

For example, when the magnitude of the voltage −Vy of the scan signal of the negative polarity direction, that is, the voltage of Vy approximately equals to the voltage Vs of the sustain signal, it is likely that the address discharge is unstable in a special situation. However, by variously controlling the magnitude of the voltage −Vy of the scan signal of the negative polarity direction using the voltage control unit 723, a problem of the generation of the unstable address discharge is solved.

It is preferable that the voltage control unit comprises a variable voltage source. An example of the voltage control unit will be described in detail with reference to FIGS. 9*a* and 9*b*.

Figure 9A:
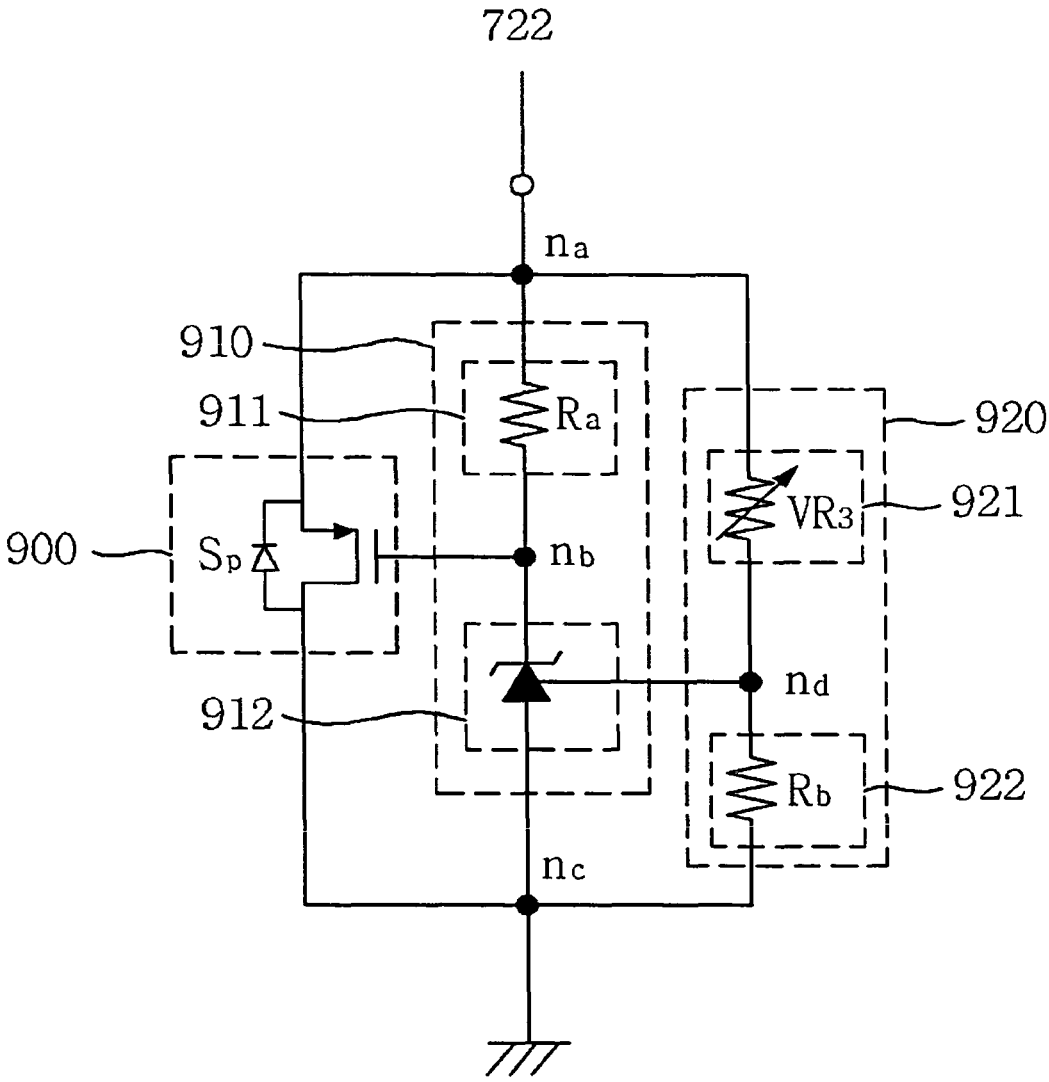
FIGS. 9*a* and 9*b* illustrate an example of a variable voltage source applied to a voltage control unit.
Figure 9B:
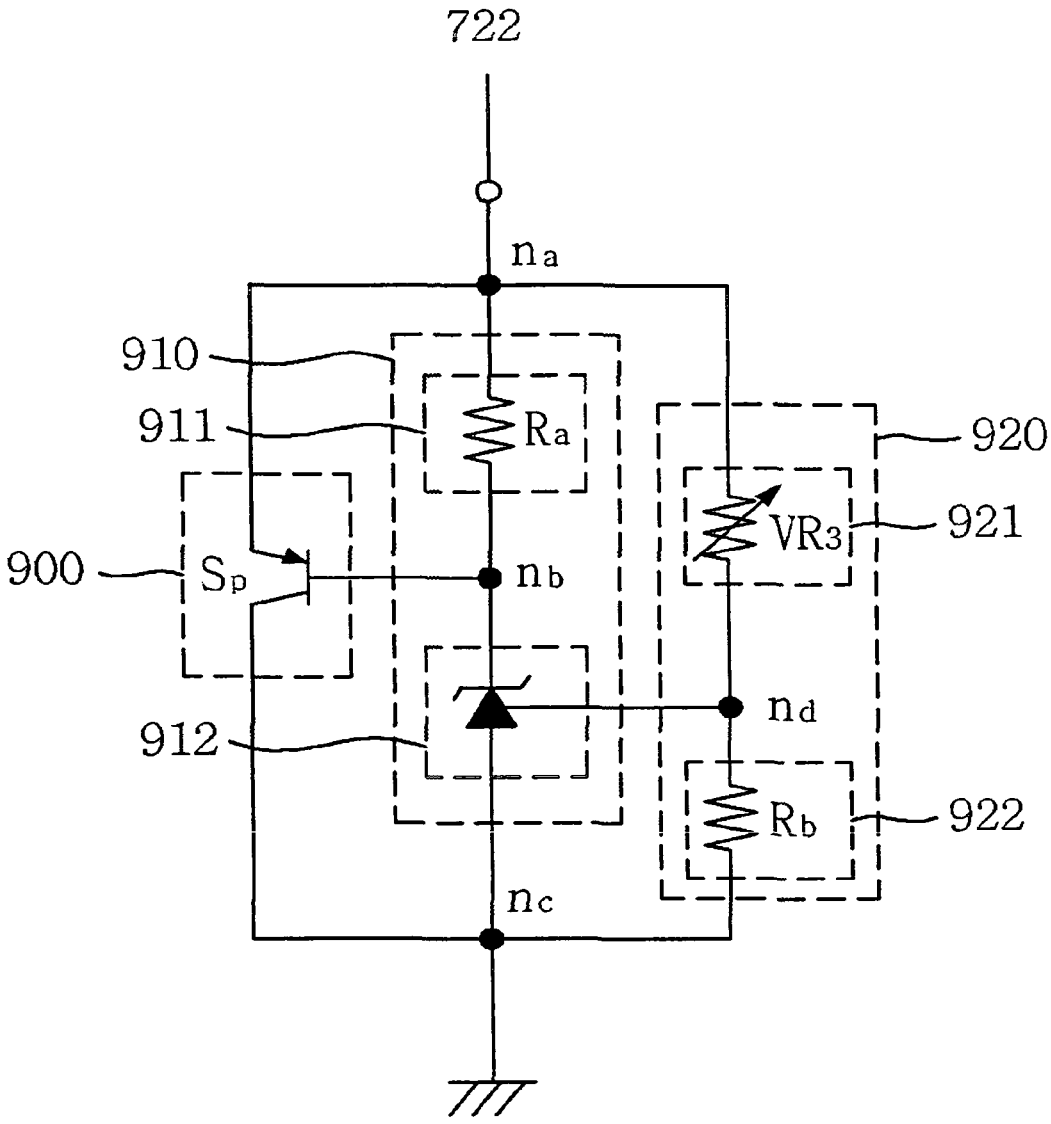

FIGS. 9*a* and 9*b* illustrate an example of a variable voltage source applied to a voltage control unit.

Referring to FIG. 9*a*, a variable voltage source applied to the voltage control unit comprises a voltage deciding switch unit 900, a voltage deciding control unit 910, and a voltage distributing unit 920.

The voltage distributing unit 920 distributes the voltage supplied through the buffer unit 722 of FIG. 7 in the previously determined ratio. The voltage distributing unit 920 comprises a first resistance unit 921 and a second resistance unit 922 which are disposed in series.

The voltage deciding switch unit 900 decides a maximum voltage stored in the voltage distributing unit 920 through a predetermined switching operation. The voltage deciding switch unit 900 comprises a voltage deciding switch comprising a P-type transistor Sp, which is disposed in parallel with the voltage distributing unit 920.

In FIG. 9*a*, the voltage deciding switch Sp comprises a P-type field effect transistor (FET), that is, a P-type metal oxide semiconductor FET (PMOSFET).

The voltage deciding control unit 910 controls the switching operation of the voltage deciding switch unit 900 depending on the voltage distributed by the voltage distributing unit 920.

The voltage deciding control unit 910 comprises a zener switching unit 912 and a third resistance unit 911 disposed in parallel with the zener switching unit 912. The zener switching unit 912 is turned on when a reference voltage Vref, preferably, a voltage stored in the second resistance unit 922 of the voltage distributing unit 920 is more than a previously determined voltage.

The first resistance unit 921 of the voltage distributing unit 920 is a variable resistance comprising a third variable resistance VR3. The other terminal of the first resistance unit 921 is connected to one terminal of the second resistance unit 922 at a d-th node nd.

A source terminal of the voltage deciding switch Sp comprising the P-type transistor is commonly connected to one terminal of the first resistance unit 921 and one terminal of the third resistance unit 911 at an a-th node na. A drain terminal of the voltage deciding switch Sp is commonly connected to an anode terminal of the zener switching unit 912 and the other terminal of the second resistance unit 922 at a c-th node nc. A gate terminal of the voltage deciding switch Sp is commonly connected to the other terminal of the third resistance unit 911 and a cathode terminal of the zener switching unit 912. A reference terminal Ref of the zener switching unit 912 is commonly connected to the other terminal of the first resistance unit 921 and one terminal of the second resistance unit 922 at the d-th node nd.

The operation of the variable voltage source of FIG. 9*a* will bed described.

When the reference voltage, that is, a voltage between the reference terminal Ref and the anode terminal in the zener switching unit 912 is 2.5 V, the zener switching unit 912 is called a TL431 regulator in which a cathode terminal is electrically connected to an anode terminal.

The reason why a function block using the TL431 regulator is called the zener switching unit is that the cathode terminal of the TL431 regulator is electrically connected to the anode terminal thereof when a voltage between a reference terminal Ref and an anode terminal of the TL431 regulator is more than a predetermined voltage, for example, 2.5V. In other words, the above electrical characteristic of the TL431 regulator is similar to an electrical characteristic of the zener switching unit.

Further, a ratio of a resistance of the first resistance unit 921 to a resistance of the second resistance unit 922 is 9:1. For example, when a resistance of the first resistance unit 921 is 900Ω, a resistance of the second resistance unit 922 is 100Ω.

When the sustain voltage supply control switch is turned on and then the voltage of the sustain signal is supplied to the a-th node na through the buffer unit, a predetermined voltage starts to be supplied to the voltage distributing unit 920. Therefore, the predetermined voltage is supplied to the first resistance unit 921 and the second resistance unit 921 of the voltage distributing unit 920, respectively.

For example, when a total voltage stored from the a-th node na to the c-th node nc is 25V, a voltage stored in the second resistance unit 921 of the voltage distributing unit 920 is 2.5V (=25×100/(900+100)).

As a result, a condition of the reference voltage for operating the zener switching unit 912 is satisfied such that the zener switching unit 912 is turned on.

The predetermined voltage is stored in the third resistance unit 911 such that a voltage between a source terminal and a gate terminal of the voltage deciding switch Sp increases. Thus, the voltage deciding switch Sp is turned on. As a result, a current path passing through the a-th node na, the voltage deciding switch Sp and the c-th node nc is formed.

When forming the current path passing through the a-th node na, the voltage deciding switch Sp and the c-th node nc, the total voltage stored in the voltage distributing unit 920, that is, the voltage stored from the a-th node na to the c-th node nc starts to decrease.

When the total voltage stored in the voltage distributing unit 920, that is, the voltage stored from the a-th node na to the c-th node nc is 25V or less, the zener switching unit 912 is turned off. Thus, the voltage deciding switch Sp is turned off such that the voltage of the voltage distributing unit 920 rises to 25V.

By repeating the above processes, the voltage of the voltage distributing unit 920 is maintained at a voltage of 25V.

Consequently, the voltage (Vs−V1) stored in the voltage storing unit 721 of FIG. 8 equals to a voltage of (Vs−25V).

In the embodiment of the present invention, the voltage supplied to the variable voltage source was set to 25V. However, a voltage supplied by the variable voltage source may be changed within the range of 1V-30V.

By controlling the third variable resistance VR3 of the first resistance unit 921, a magnitude of the total voltage of the voltage distributing unit 920 is controlled. Consequently, a magnitude of the voltage (Vs−V1) of the voltage storing unit 721 of FIG. 8 is controlled.

In FIG. 9*a*, the voltage deciding switch Sp comprises the P-type FET, that is, the PMOSFET. However, as illustrated in FIG. 9*b*, the voltage deciding switch Sp may comprise a p-type bipolar junction transistor (BJT).

An emitter terminal, a collector terminal and a base terminal of the p-type BJT in FIG. 9*b* correspond to the source terminal, the drain terminal and the gate terminal of the PMOSFET in FIG. 9*a*, respectively. Further, a switching operation of the p-type BJT substantially equals to the switching operation of the PMOSFET. Therefore, the switching operation of the p-type BJT is omitted.

In the embodiment of the present invention, the voltage control unit 723 comprises the variable voltage source and the magnitude of the voltage −Vy of the scan signal of the negative polarity direction is controlled. However, the magnitude of the voltage −Vy of the scan signal of the negative polarity direction may be controlled using another external voltage source. This will be described in detail with reference to FIG. 10.

Figure 10:
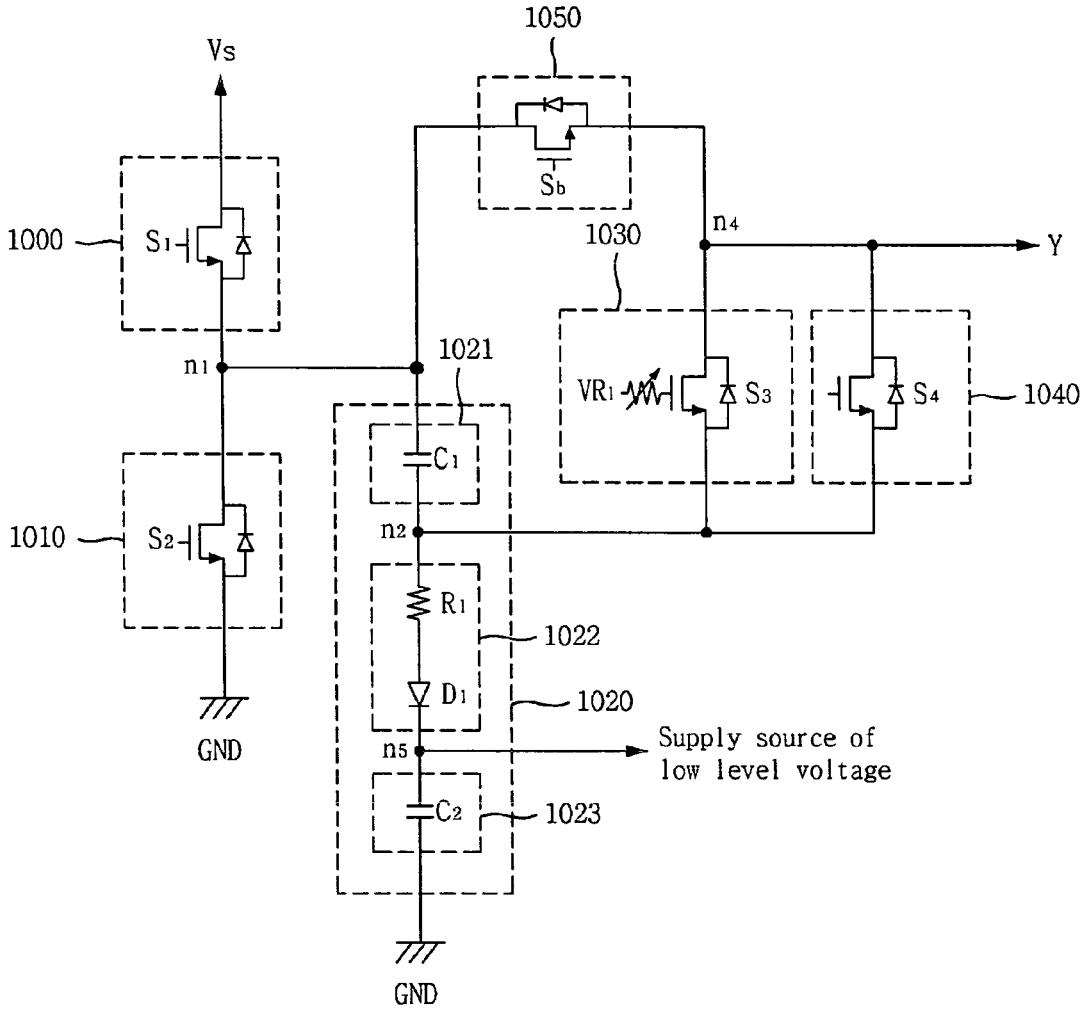
FIG. 10 illustrates another structure of a scan driver different from the scan driver of FIG. 7 in the plasma display apparatus according to one embodiment of the present invention.

FIG. 10 illustrates another structure of a scan driver different from the scan driver of FIG. 7 in the plasma display apparatus according to one embodiment of the present invention.

Referring to FIG. 10, the scan driver of the plasma display apparatus according to one embodiment of the present invention comprises a sustain voltage supply control unit 1000, a ground voltage supply control unit 1010, a negative polarity scan voltage generating unit 1020, a falling signal supply control unit 1030, a scan voltage supply control unit 1040, and a blocking unit 1050.

The negative polarity scan voltage generating unit 1020 comprises a voltage storing unit 1021, a buffer unit 1022 and a voltage control unit 1023.

Since the sustain voltage supply control unit 1000, the ground voltage supply control unit 1010, the falling signal supply control unit 1030, the scan voltage supply control unit 1040 and the blocking unit 1050 are illustrated and described above, a description thereof is omitted.

The negative polarity scan voltage generating unit 1020 generates a voltage −Vy of a scan signal of a negative polarity direction having a polarity direction opposite a polarity direction of a voltage Vs of a sustain signal, using the voltage Vs of the sustain signal supplied under the control of the sustain voltage supply control unit 1000 and a ground level voltage GND supplied under the control of the ground voltage supply control unit 1010.

The voltage storing unit 1021 comprises a first capacitor C1. The buffer unit 1022 comprises a load reduction resistance R1 and a reverse blocking diode D1.

The voltage control unit 1023 comprises a second capacitor C2. The second capacitor C2 is used to store a voltage supplied by an external low level voltage supply source.

One terminal of the buffer unit 1022 is commonly connected to one terminal of the voltage storing unit 1021, one terminal of the falling signal supply control unit 1030, and one terminal of the scan voltage supply control unit 1040 at a second node n2. The other terminal of the buffer unit 1022 is commonly connected to one terminal of the voltage control unit 1023 and the low level voltage supply source for supplying a voltage less than the voltage Vs of the sustain signal at a fifth node n5. The other terminal of the voltage control unit 1023 is grounded.

It is preferable that the low level voltage supply source comprises a data voltage source for supplying the data voltage Vd to the address electrode X in the address period, or a DC voltage source for supplying a voltage of a predetermined control signal for controlling the driving of the scan driver of the plasma display apparatus according to one embodiment of the present invention.

As previously illustrated in FIGS. 4*a* and 4*b*, it is possible to construct the scan driver for supplying not only the voltage −Vy of the scan signal of the negative polarity direction, the voltage Vs of the sustain signal and the voltage of the falling signal but also a voltage of a rising signal, a scan reference voltage Vsc, and the like, to the scan electrode Y by adding predetermined elements to the scan driver of the FIG. 10.

Since the above-described structure was illustrated with reference to FIGS. 4*a* and 4*b*, a description thereof is omitted.

An operation of the scan driver of FIG. 10 will be described in detail with reference to FIG. 11.

Figure 11:
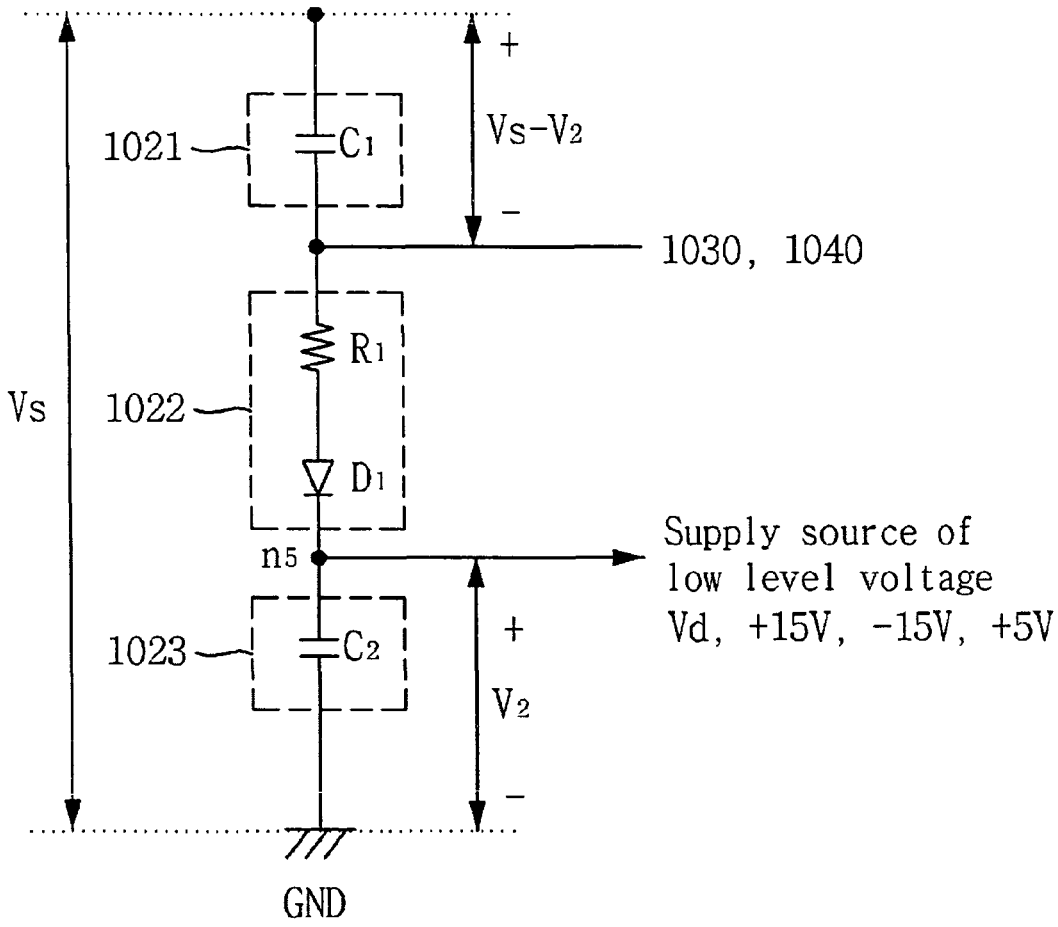
FIG. 11 illustrates an operation of a negative polarity scan voltage generating unit in the scan driver of FIG. 10.

FIG. 11 illustrates an operation of a negative polarity scan voltage generating unit in the scan driver of FIG. 10.

Referring FIG. 11, a magnitude of a total voltage of the negative polarity scan voltage generating unit 1020 equals to the voltage Vs of the sustain signal.

When the voltage supplied by the low level voltage supply source is a voltage of 15V of a control signal for controlling operations of the switching elements of the scan driver, a voltage of V2, that is, a voltage of 15V supplied by the low level voltage supply source is stored in the second capacitor C2 of the voltage control unit 1023.

In the embodiment of the present invention, the voltage of the control signal for controlling the operations of the switching elements of the scan driver is set to 15V. However, the voltage of the control signal may be set to various voltages such as 5V or −15V.

A magnitude of the voltage stored in the voltage storing unit 1021 approximately equals to a voltage of (Vs−15V). At this time, the voltage of the buffer unit 1022 was set to 0V.

The voltage of (Vs−15V) stored in the voltage storing unit 1021 is reversed to a voltage of −(Vs−15V) through the same processes as the processes illustrated in FIGS. 6*a* and 6*b*. The reversed voltage of −(Vs−15V) is supplied to the falling signal supply control unit 1030 or the scan voltage supply control unit 1040.

So far, only the scan driver having the structure, in which two or more voltage sources are integrated into one common voltage source, was described. However, the structure, in which two or more voltage sources are integrated into one common voltage source, may be applied to the sustain driver. The sustain driver having the above structure will be described in detail with reference to FIG. 12.

Figure 12:
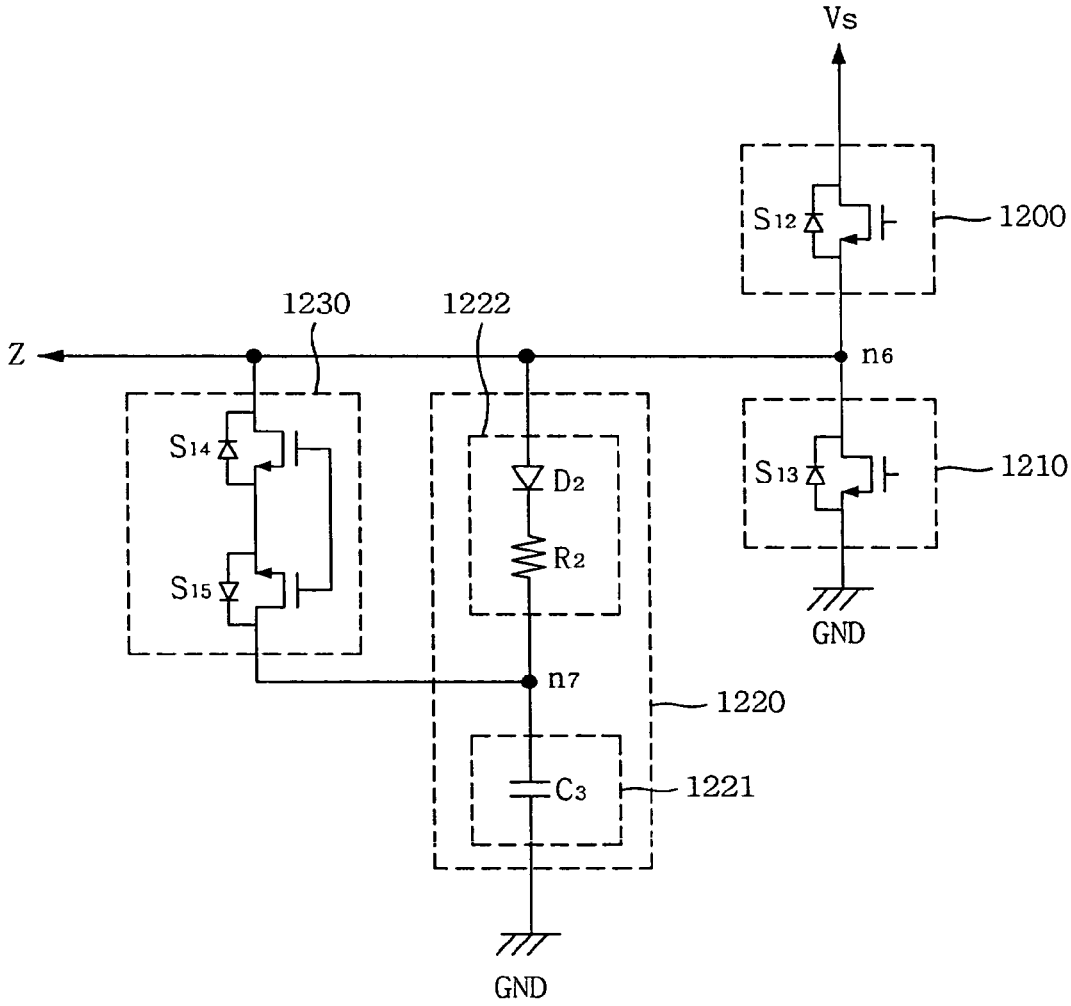
FIG. 12 illustrates a structure of a sustain driver of a plasma display apparatus according to another embodiment of the present invention.

FIG. 12 illustrates a structure of a sustain driver of a plasma display apparatus according to another embodiment of the present invention.

Referring to FIG. 12, a sustain driver of a plasma display apparatus according to another embodiment of the present invention generates a voltage Vs of a sustain signal supplied to a sustain electrode Z of a plasma display panel during a sustain period, and a sustain bias voltage Vzb supplied to the sustain electrode Z during an address period prior to the sustain period, using one voltage source.

Since the voltage Vs of the sustain signal and the sustain bias voltage Vzb are generated from one voltage source, a separate voltage source for generating the sustain bias voltage Vzb is not required. Therefore, the fabricating cost of the plasma display apparatus according to another embodiment of the present invention decreases.

It is preferable that one common voltage source comprises a sustain voltage source for generating the voltage Vs of the sustain signal.

The sustain driver comprises a sustain voltage supply control unit 1200, a ground voltage supply control unit 1210, a bias voltage generating unit 1220, and a bias voltage supply control unit 1230.

The sustain voltage supply control unit 1200 comprises a sustain voltage supply control switch S12. The sustain voltage supply control unit 1200 controls the supply of the voltage Vs of the sustain signal to the sustain electrode Z in response to a switching operation of the sustain voltage supply control switch S12.

The ground voltage supply control unit 1210 comprises a ground voltage supply control switch S13. The ground voltage supply control unit 1210 controls the supply of a ground level voltage GND to the sustain electrode Z in response to a switching operation of the ground voltage supply control switch S13.

The bias voltage generating unit 1220 generates the sustain bias voltage Vzb having a polarity direction equal to a polarity direction of the voltage Vs of the sustain signal supplied by the sustain voltage supply control unit 1200, using the voltage Vs of the sustain signal and the ground level voltage GND.

The bias voltage supply control unit 1230 controls the supply of the sustain bias voltage Vzb to the sustain electrode Z.

The bias voltage supply control unit 1230 comprises two bias voltage supply control switches S14 and S15 whose inner diodes are disposed in a reverse direction.

The two bias voltage supply control switches S14 and S15 are alternately turned on or off such that the sustain bias voltage Vzb is supplied to the sustain electrode Z.

The bias voltage generating unit 1220 for generating the sustain bias voltage Vzb supplied to the bias voltage supply control unit 1230 will be described in detail.

The bias voltage generating unit 1220 comprises a voltage storing unit 1221 and a buffer unit 1222.

The buffer unit 1222 is linked with the voltage storing unit 1221 which will be described below. Further, the buffer unit 1222 stabilizes an operation of the voltage storing unit 1221. One terminal of the buffer unit 1222 is commonly connected to one terminal of the sustain voltage supply control unit 1200, one terminal of the ground voltage supply control unit 1210, and one terminal of the bias voltage supply control unit 1230 at a sixth node n6.

Further, the other terminal of the buffer unit 1222 is commonly connected to one terminal of the voltage storing unit 1221 and the other terminal of the bias voltage supply control unit 1230 at a seventh node n7.

The buffer unit 1222 comprises a load reduction resistance R2 and a reverse blocking diode D2.

The load reduction resistance R2 and the reverse blocking diode D2 are disposed in series between the sixth node n6 and the seventh node n7. The sixth node n6 is a connection terminal of one terminal of the sustain voltage supply control unit 1200, one terminal of the ground voltage supply control unit 1210, and one terminal of the bias voltage supply control unit 1230. The seventh node n7 is a connection terminal of the other terminal of the bias voltage supply control unit 1230 and the voltage storing unit 1221.

A cathode and an anode of the reverse blocking diode D2 are connected to the seventh node n7 and the sixth node n6, respectively.

The voltage storing unit 1221 comprises a third capacitor C3 for storing a part or all of the voltage Vs of the sustain signal supplied under the control of the sustain voltage supply control unit 1200. The part or all of the voltage Vs of the sustain signal is stored in the third capacitor C3.

The voltage stored in the third capacitor C3 equals to the sustain bias voltage Vzb supplied to the bias voltage supply control unit 1230.

It is preferable that one terminal of the voltage storing unit 1221 is commonly connected to the other terminal of the bias voltage supply control unit 1230 and the buffer unit 1222 at the seventh node n7. The other terminal of the voltage storing unit 1221 is grounded.

The structure of the sustain driver for supplying the sustain bias voltage Vzb to the sustain electrode Z was illustrated in FIG. 12.

By adding predetermined elements to the sustain driver of FIG. 12, the sustain driver for supplying the sustain bias voltage Vzb to the sustain electrode Z, and also for recovering a reactive energy from the sustain electrode Z can be constructed.

The above sustain driver will be described in detail with reference to FIG. 13.

Figure 13:
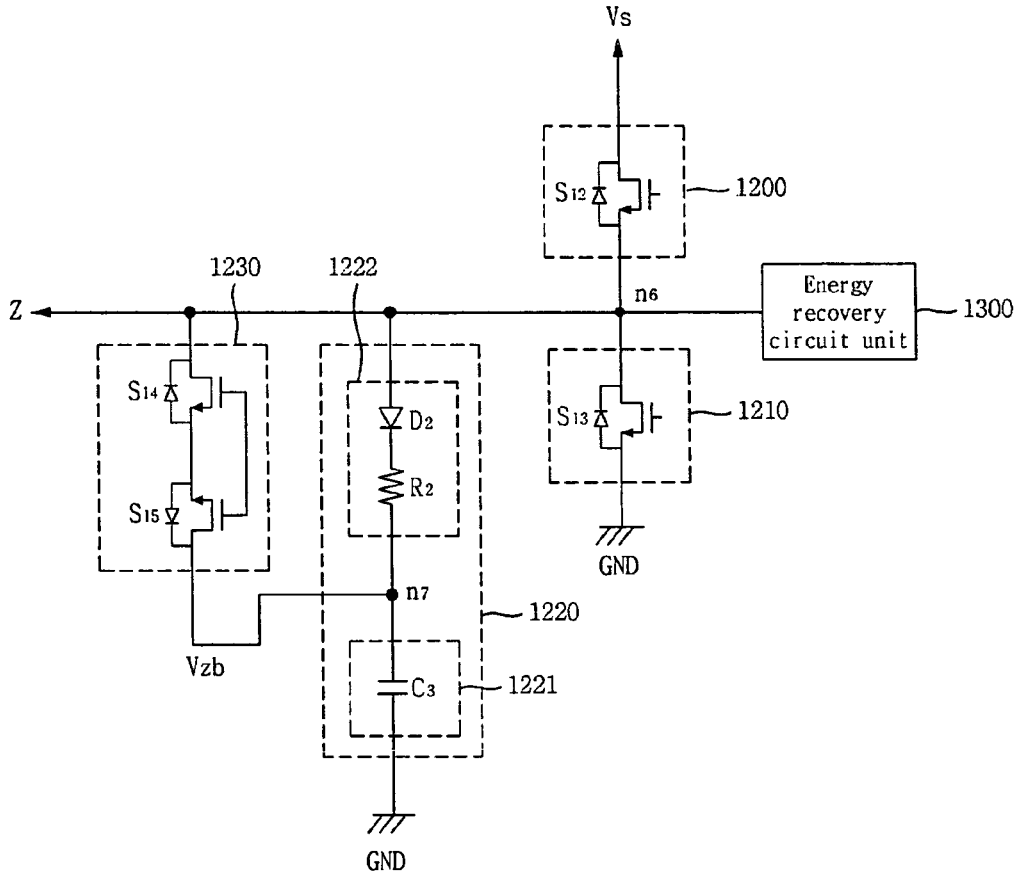
FIG. 13 illustrates an extended structure of the sustain driver of the plasma display apparatus according to another embodiment of the present invention.

FIG. 13 illustrates an extended structure of the sustain driver of the plasma display apparatus according to another embodiment of the present invention.

Referring to FIG. 13, the sustain driver of the plasma display apparatus according to another embodiment of the present invention may further comprise an energy recovery circuit unit 1300.

The energy recovery circuit unit 1300 may be connected to a connection terminal of the sustain voltage supply control unit 1200 and the ground voltage supply control unit 1210, that is, to the sixth node n6.

The energy recovery circuit unit 1300 supplies the previously stored energy to the sustain electrode Z and recovers the reactive energy from the sustain electrode Z.

Since the energy recovery circuit unit 1300 was described and illustrated in FIG. 4*b*, a description thereof is omitted.

An operation of the sustain driver of the plasma display apparatus according to another embodiment of the present invention will be described in detail with reference to FIG. 14.

Figure 14:
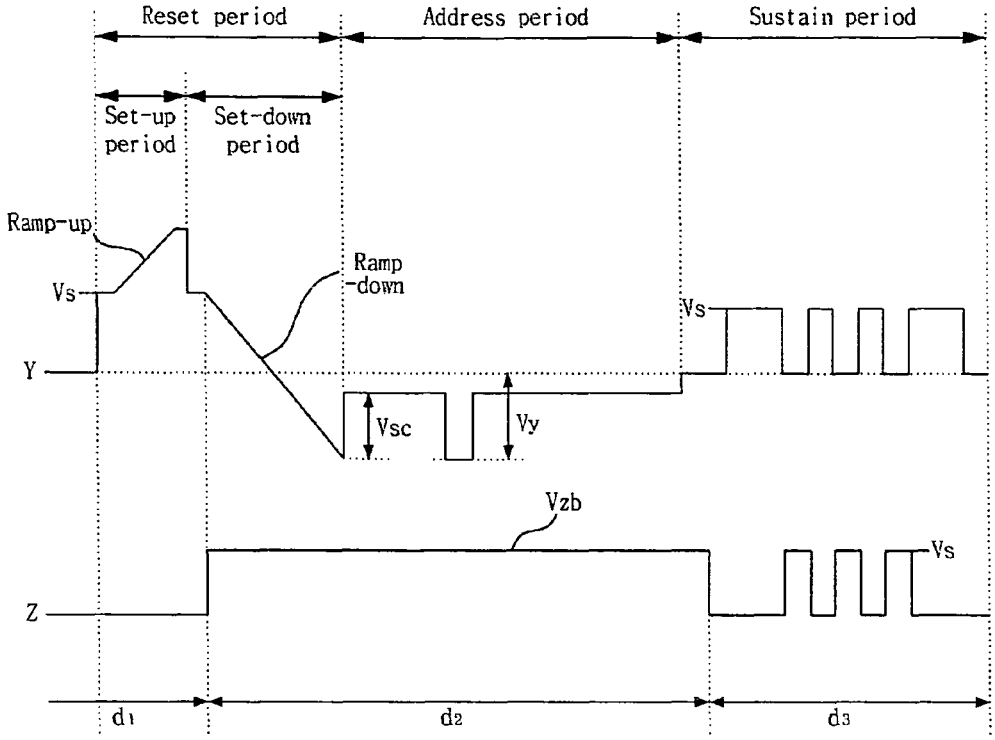
FIG. 14 illustrates an operation of the sustain driver of the plasma display apparatus according to another embodiment of the present invention.

FIG. 14 illustrates an operation of the sustain driver of the plasma display apparatus according to another embodiment of the present invention.

An example of a driving waveform generated by the sustain driver of the plasma display apparatus according to another embodiment of the present invention is illustrated in FIG. 14.

When the ground voltage supply control switch S13 of the ground voltage supply control unit 1210 of FIG. 13 is turned on, a ground level voltage is supplied to the sustain electrode Z of the plasma display panel. As a result, a voltage of the sustain electrode Z equals to a ground level voltage in a period d1 of FIG. 14.

Next, when the ground voltage supply control switch S13 is turned off and the two bias voltage supply control switches S14 and S15 of the bias voltage supply control unit 1230 are turned on, the voltage stored in the third capacitor C3 of the voltage storing unit 1221 of the bias voltage generating unit 1220, that is, the sustain bias voltage Vzb is supplied to the sustain electrode Z of the plasma display panel. As a result, a voltage of the sustain electrode Z equals to the sustain bias voltage Vzb in a period d2 of FIG. 14.

To supply the sustain bias voltage Vzb to the sustain electrode Z, the part or all of the voltage Vs of the sustain signal, that is, the sustain bias voltage Vzb needs to be stored in the voltage storing unit 1221 of the bias voltage generating unit 1220

To store the voltage Vs of the sustain signal in the voltage storing unit 1221, the sustain voltage supply control switch S12 of the sustain voltage supply control unit 1200 needs to be turned on.

When the sustain voltage supply control switch S12 is turned on, a current path passing through the sustain voltage supply control unit 1200, the buffer unit 1222, the voltage storing unit 1221, and the ground is formed. Thus, the part or all of the voltage Vs the sustain signal, that is, the sustain bias voltage Vzb is stored in the third capacitor C3 of the voltage storing unit 1221.

To store the sustain bias voltage Vzb in the voltage storing unit 1221, the switching operation of the sustain supply control switch S12 needs to be controlled separately. However, the sustain bias voltage Vzb may be stored in the voltage storing unit 1221 in the process for supplying the sustain signal to the sustain electrode Z.

Because the sustain voltage supply control switch S12 of the sustain voltage supply control unit 1200 is turned on in the process for supplying the sustain signal to the sustain electrode Z.

When the sustain signal is supplied to the sustain electrode Z, the two bias voltage supply control switches S14 and S15 of the bias voltage supply control unit 1230 are turned off and the sustain voltage supply control switch S12 and the ground voltage supply control switch S13 are alternately turned on or off. As a result, the sustain bias voltage Vzb is stored in the voltage storing unit 1221.

Further, the energy recovery circuit unit 1300 performs repeatedly a supply operation/a recovery operation of the energy to/from the sustain electrode Z such that the voltage of the sustain electrode Z rises to the voltage Vs of the sustain signal and then falls to a ground level voltage. That is, the sustain signal is supplied to the sustain electrode Z.

Another structure of the sustain driver in the plasma display apparatus according to another embodiment of the present invention will be described in detail with reference to FIG. 15.

Figure 15:
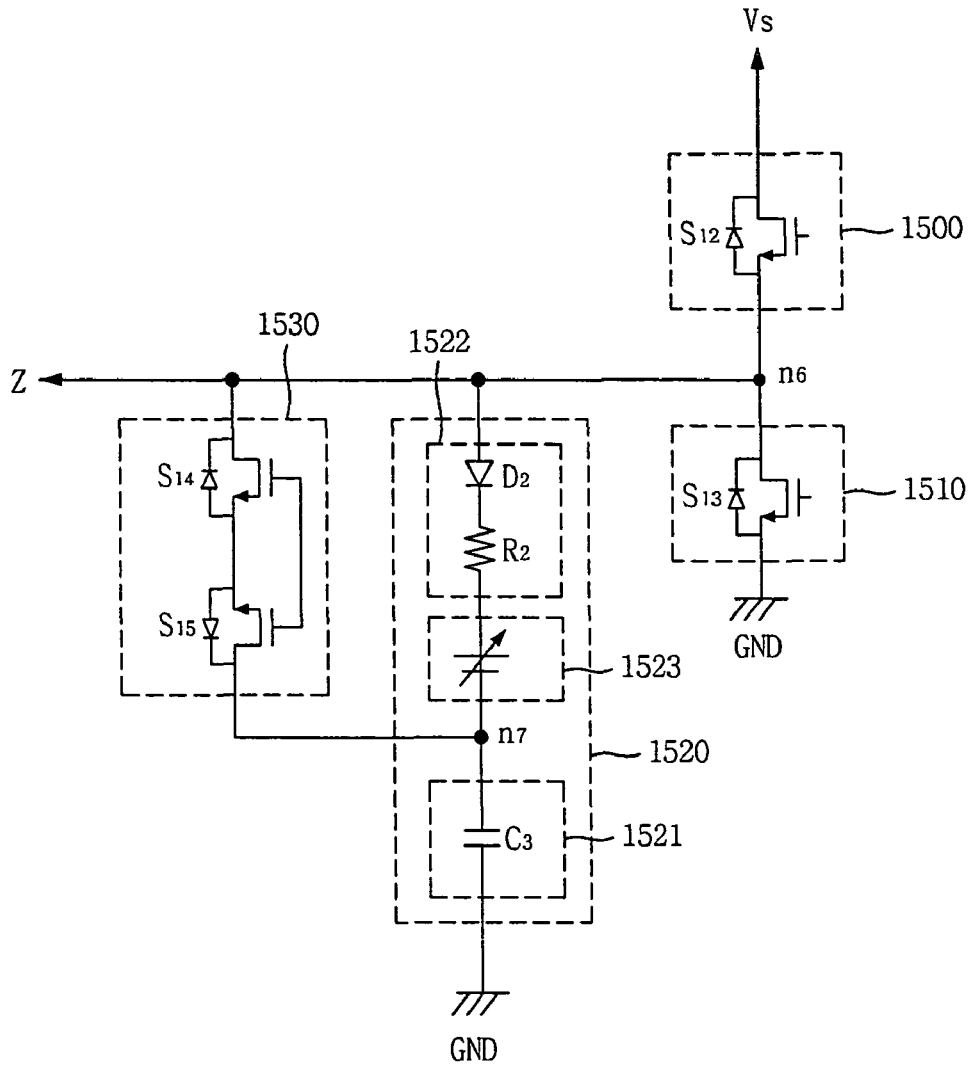
FIG. 15 illustrates another structure of the sustain driver in the plasma display apparatus according to another embodiment of the present invention.

FIG. 15 illustrates another structure of the sustain driver in the plasma display apparatus according to another embodiment of the present invention.

Referring to FIG. 15, the sustain driver of the plasma display apparatus according to another embodiment of the present invention comprises a sustain voltage supply control unit 1500, a ground voltage supply control unit 1510, a bias voltage generating unit 1520, and a bias voltage supply control unit 1530. The bias voltage generating unit 1520 comprises a voltage storing unit 1521, a buffer unit 1522 and a voltage control unit 1523.

The voltage storing unit 1521 stores a part of the voltage Vs of the sustain signal supplied under the control of the sustain voltage supply control unit 1500. The voltage stored in the voltage storing unit 1521 equals to the sustain bias voltage Vzb.

The buffer unit 1522 is linked with the voltage storing unit 1521, and stabilizes an operation of the voltage storing unit 1521.

The voltage control unit 1523 controls a magnitude of the voltage stored in the voltage storing unit 1521.

A voltage subtracting the voltage of the voltage control unit 1523 from the voltage Vs of the sustain signal is stored in the voltage storing unit 1521. In other words, a magnitude of the voltage stored in the voltage storing unit 1521 approximately equals to a difference between the voltage Vs of the sustain signal and the voltage of the voltage control unit 1523.

Consequently, the voltage control unit 1523 controls the magnitude of the voltage stored in the voltage storing unit 1521.

Since the sustain voltage supply control unit 1500, the ground voltage supply control unit 1510 and the bias voltage supply control unit 1530 were illustrated and described in FIGS. 12 and 13, a description thereof is omitted.

The bias voltage generating unit 1520 generates the sustain bias voltage Vzb having a polarity direction equal to a polarity direction of the voltage Vs of the sustain signal, using the voltage Vs of the sustain signal supplied under the control of the sustain voltage supply control unit 1500 and the ground level voltage GND supplied under the control of the ground voltage supply control unit 1510.

The voltage storing unit 1521 of the bias voltage generating unit 1520 comprises a third capacitor C3 for storing a part of the voltage Vs of the sustain signal supplied under the control of the sustain voltage supply control unit 1500.

One terminal of the voltage storing unit 1521 is commonly connected to the other terminal of the bias voltage supply control unit 1530 and the other terminal of the voltage control unit 1523 at a seventh node n7. The other terminal of the voltage storing unit 1521 is grounded.

One terminal of the buffer unit 1522 is commonly connected to a connection terminal of one terminal of the sustain voltage supply control unit 1500, one terminal of the ground voltage supply control unit 1510, and one terminal of the bias voltage supply control unit 1530, that is, to a sixth node n6. The other terminal of the buffer unit 1522 is connected to one terminal of the voltage control unit 1523.

In other words, one terminal of the voltage control unit 1523 is connected to the other terminal of the buffer unit 1522. The other terminal of the voltage control unit 1523 is commonly connected to the other terminal of the bias voltage supply control unit 1530 and one terminal of the voltage storing unit 1521 at a seventh node n7.

As previously illustrated in FIGS. 4*a* and 4*b*, it is possible to construct the sustain driver for supplying not only the voltage −Vy of the scan signal of the negative polarity direction and the voltage of the falling signal but also a voltage of a rising signal, a scan reference voltage Vsc, and the like, to the scan electrode Y by adding predetermined elements to the sustain driver of the FIG. 15. Since the above-described structure was illustrated with reference to FIGS. 4*a* and 4*b*, a description thereof is omitted.

An operation of the plasma display apparatus according to another embodiment of the present invention will be described in detail with reference to FIG. 16.

Figure 16:
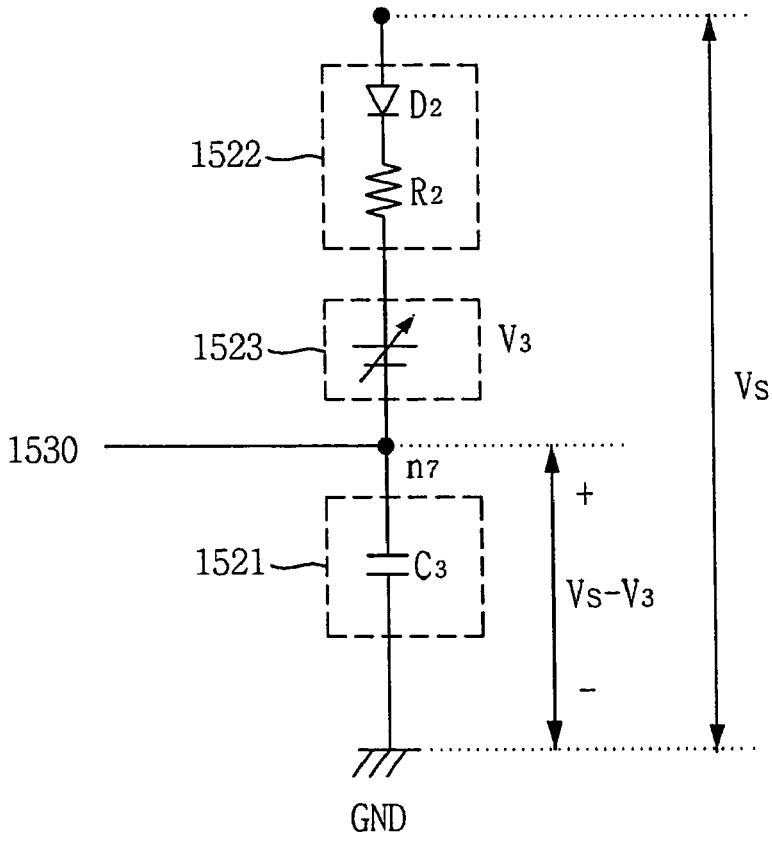
FIG. 16 illustrates an operation of a bias voltage generating unit in the sustain driver of FIG. 15.

FIG. 16 illustrates an operation of a bias voltage generating unit in the sustain driver of FIG. 15.

Referring to FIG. 16, when a magnitude of the total voltage stored in the bias voltage generating unit 1520 equals to the voltage Vs of the sustain signal and the voltage stored in the voltage control unit 1523 equals to V3, a magnitude of the voltage stored in the voltage storing unit 1521 approximately equals to a voltage of (Vs−V3). At this time, the voltage stored in the buffer unit 1522 was set to 0V.

The voltage of (Vs−V3) stored in the voltage storing unit 1521 equals to the sustain bias voltage Vzb. A magnitude of the sustain bias voltage Vzb is variously controlled It is preferable that the voltage control unit is a variable voltage source. An example of the voltage control unit was illustrated in detail in FIGS. 9*a* and 9*b*.

So far, the variable voltage source used as the voltage control unit controlled the magnitude of the sustain bias voltage Vzb. However, it is possible to control the magnitude of the sustain bias voltage Vzb using an another external voltage source. The control of the magnitude of the sustain bias voltage Vzb using the another external voltage source will be described in detail with reference to FIG. 17.

Figure 17:
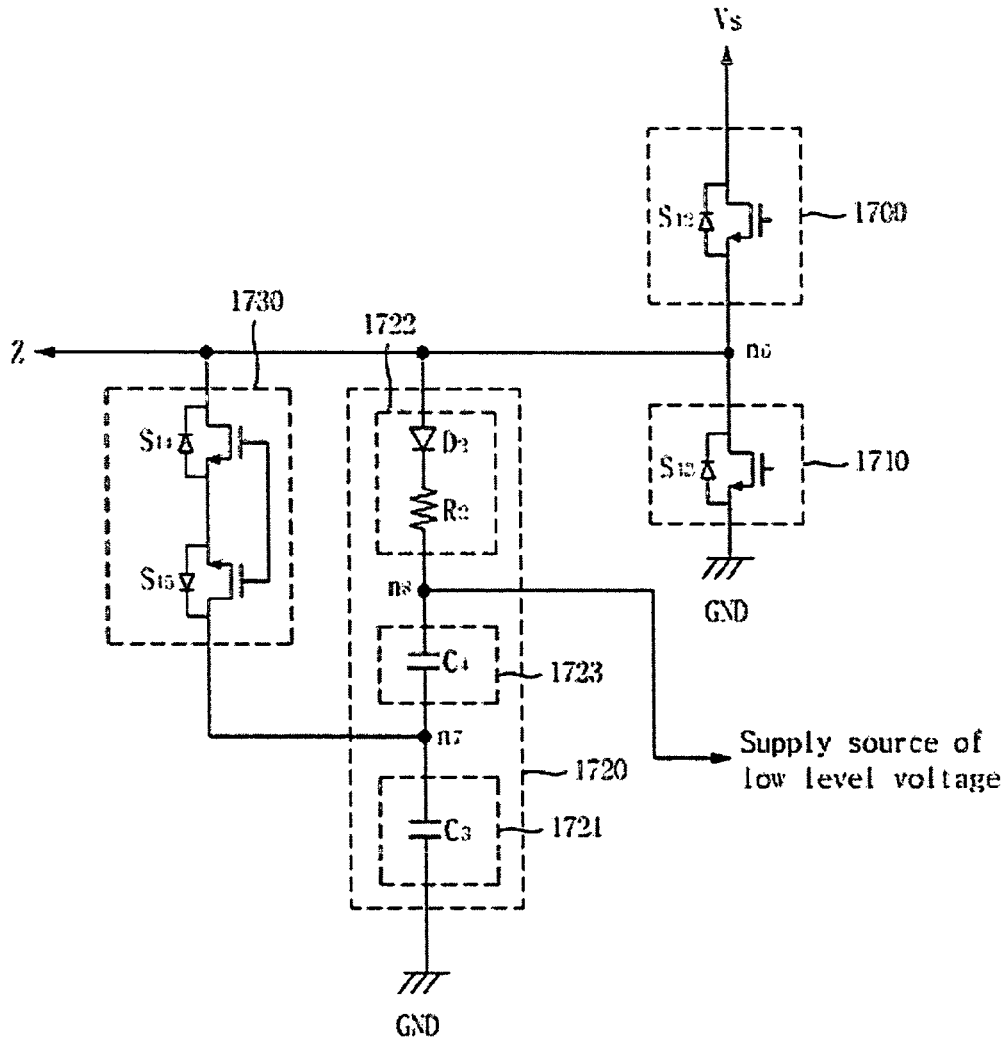
FIG. 17 illustrates another structure of a sustain driver different from the sustain driver of FIG. 15 in the plasma display apparatus according to another embodiment of the present invention.

FIG. 17 illustrates another structure of a sustain driver different from the sustain driver of FIG. 15 in the plasma display apparatus according to another embodiment of the present invention.

Referring to FIG. 17, the sustain driver of the plasma display apparatus according to another embodiment of the present invention comprises a sustain voltage supply control unit 1700, a ground voltage supply control unit 1710, a bias voltage generating unit 1720, and a bias voltage supply control unit 1730.

The bias voltage generating unit 1720 comprises a voltage storing unit 1721, a buffer unit 1722 and a voltage control unit 1723.

Since the sustain voltage supply control unit 1700, the ground voltage supply control unit 1710 and the bias voltage supply control unit 1730 were previously illustrated and described, a description thereof is omitted.

The voltage storing unit 1721 comprises a third capacitor C3. The buffer unit 1722 comprises a load reduction resistance R2 and a reverse blocking diode D2.

The voltage control unit 1723 comprises a fourth capacitor C4. The fourth capacitor C4 is used to store a voltage supplied by an external low level voltage supply source.

One terminal of the buffer unit 1722 is commonly connected to one terminal of the sustain voltage supply control unit 1700, one terminal of the ground voltage supply control unit 1710, and one terminal of the bias voltage supply control unit 1730 at a sixth node n6. The other terminal of the buffer unit 1722 is commonly connected to one terminal of the voltage control unit 1723 and the low level voltage supply source for supplying a voltage less than the voltage Vs of the sustain signal at an eighth node n8.

One terminal of the voltage control unit 1723 is commonly connected to the low level voltage supply source and the other terminal of the buffer unit 1722. The other terminal of the voltage control unit 1723 is commonly connected to the other terminal of the bias voltage supply control unit 1730 and one terminal of the voltage storing unit 1721 at a seventh node n7. The other terminal of the voltage storing unit 1721 is grounded.

It is preferable that the low level voltage supply source comprises a data voltage source for supplying the data voltage Vd to the address electrode X in the address period, or a DC voltage source for supplying a voltage of a predetermined control signal for controlling the driving of the sustain driver of the plasma display apparatus according to another embodiment of the present invention.

As previously illustrated in FIGS. 4*a* and 4*b*, it is possible to construct the sustain driver for supplying not only the voltage −Vy of the scan signal of the negative polarity direction and the voltage of the falling signal but also a voltage of a rising signal, a scan reference voltage Vsc, and the like, to the scan electrode Y by adding predetermined elements to the sustain driver of the FIG. 17.

Since the above-described structure was illustrated with reference to FIGS. 4*a* and 4*b*, a description thereof is omitted.

An operation of the sustain driver of the plasma display apparatus according to another embodiment of the present invention of FIG. 17 will be described in detail with reference to FIG. 18.

Figure 18:
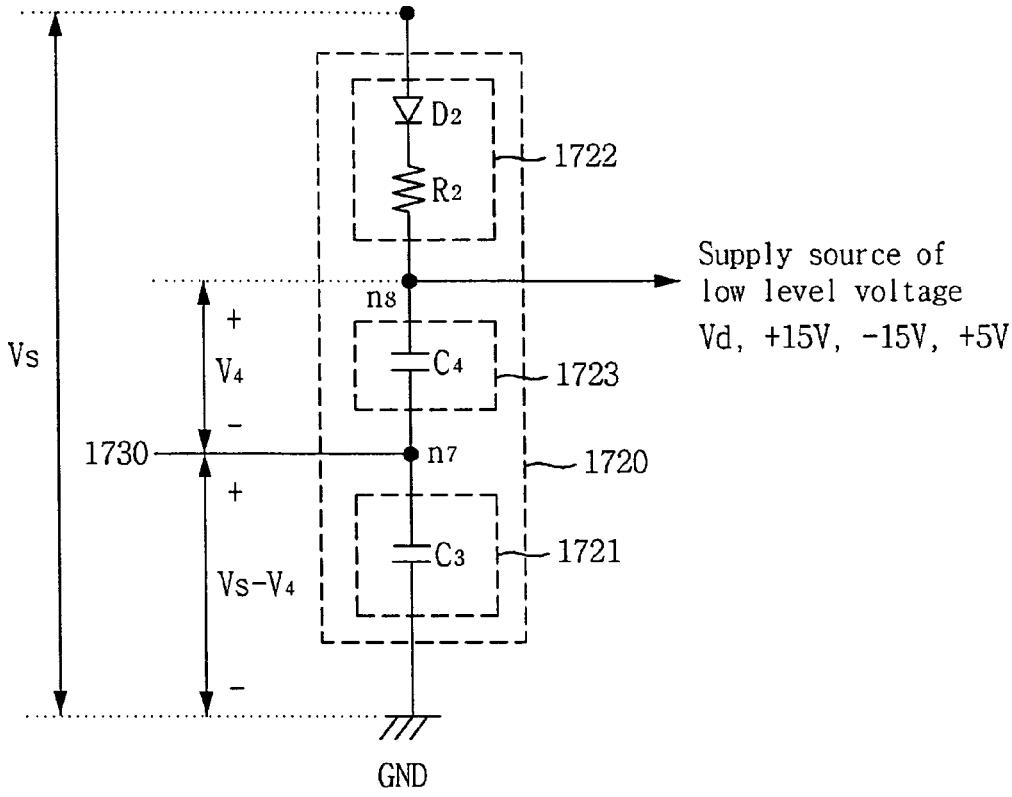
FIG. 18 illustrates an operation of a bias voltage generating unit in the sustain driver of FIG. 17.

FIG. 18 illustrates an operation of a bias voltage generating unit in the sustain driver of FIG. 17.

In FIG. 18, a magnitude of a total voltage of the bias voltage generating unit equals to the voltage Vs of the sustain signal.

When the voltage supplied by the low level voltage supply source is a control signal of 15V for controlling operations of the switching elements of the sustain driver, a voltage of V4, that is, a voltage of 15V supplied by the low level voltage supply source is stored in the fourth capacitor C4 of the voltage control unit 1723.

In the embodiment of the present invention, the voltage of the control signal for controlling the operations of the switching elements of the sustain driver is set to 15V. However, the voltage of the control signal may be set to various voltages such as 5V or −15V.

A magnitude of the voltage of the voltage storing unit 1721 approximately equals to a voltage of (Vs−15V). At this time, the voltage of the buffer unit 1722 was set to 0V.

The voltage of Vs−15V stored in the voltage storing unit 1721 equals to the sustain bias voltage Vzb, and the sustain bias voltage Vzb is supplied to the bias voltage supply control unit 1730.

It is possible to together embody the above-described scan driver and the above-described sustain driver. This will be described in detail with reference to FIG. 19.

Figure 19:
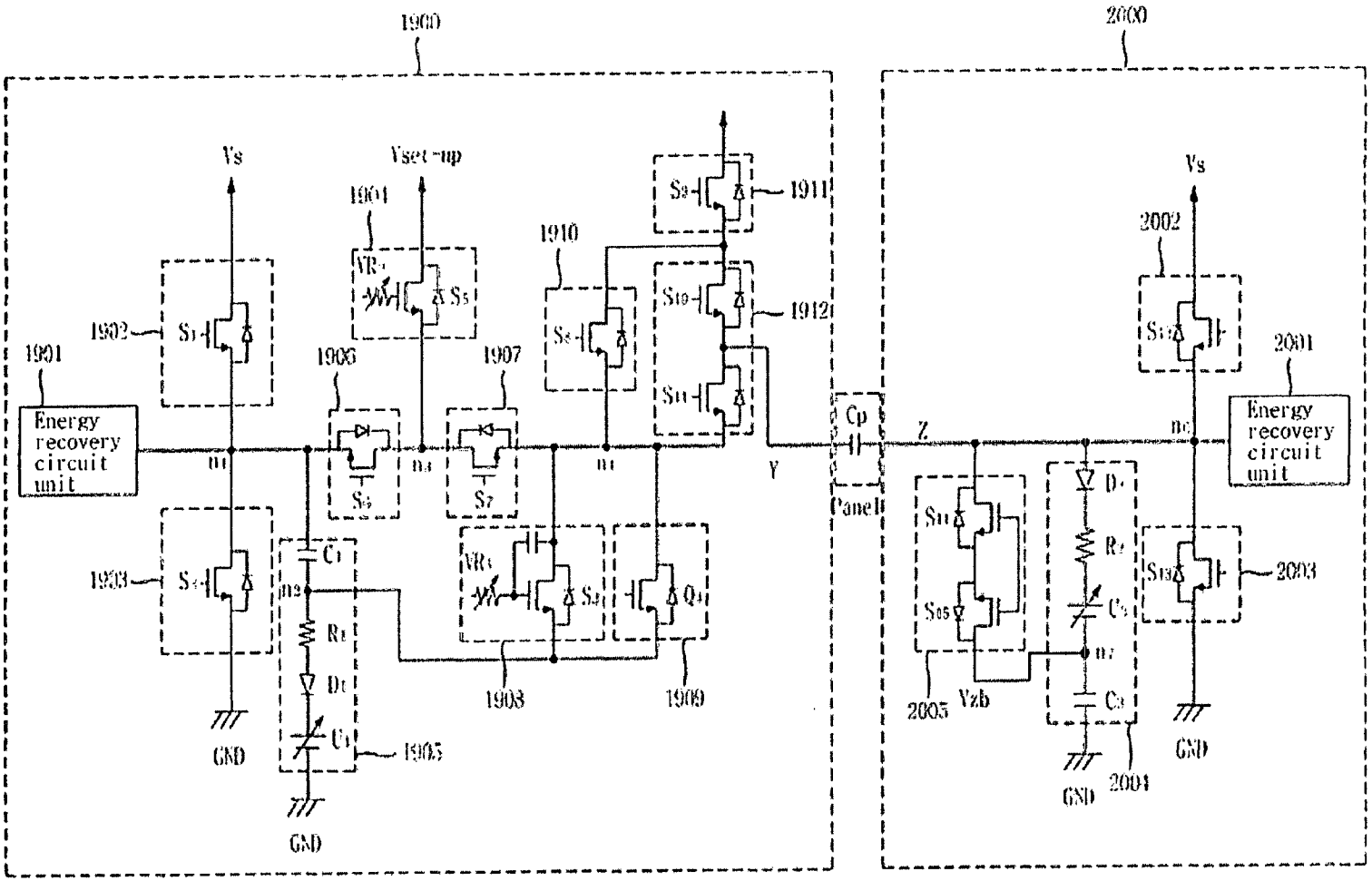
FIG. 19 illustrates an example for together embodying the scan driver and the sustain driver in the plasma display apparatus according to the embodiments of the present invention.

FIG. 19 illustrates an example for together embodying the scan driver and the sustain driver in the plasma display apparatus according to the embodiments of the present invention.

Referring to FIG. 19, the scan driver of the plasma display apparatus according to one embodiment of the present invention illustrated in detail in FIGS. 3 through 11 is connected to the scan electrode Y of the plasma display panel. Further, the sustain driver of the plasma display apparatus according to another embodiment of the present invention illustrated in detail in FIGS. 12 through 18 is connected to the sustain electrode Z of the plasma display panel.

In other words, the scan driver of the plasma display apparatus according to one embodiment of the present invention illustrated in detail in FIGS. 3 through 11, and the sustain driver of the plasma display apparatus according to another embodiment of the present invention illustrated in detail in FIGS. 12 through 18 are together embodied.

As illustrated in FIG. 19, by together embodying the scan driver for generating the voltage −Vy of the scan signal of the negative polarity direction, the voltage of the falling signal and the voltage Vs of the sustain signal using one voltage source, and the sustain driver for generating the voltage Vs of the sustain signal and the sustain bias voltage Vzb using one voltage source, separate voltage sources for generating the voltage −Vy of the scan signal of the negative polarity direction and the voltage of the falling signal and a separate voltage source for generating the sustain bias voltage Vzb are not required. Consequently, the fabricating cost of the plasma display apparatus according to the embodiments of the present invention decreases.

Since the plasma display apparatus according to the embodiments of the present invention of FIG. 19 was illustrated and described in detail in FIGS. 3 through 18, a description thereof is omitted.

The explanation was given of an example of the structure, in which the scan driver and the sustain driver are formed on individual driving boards, in the embodiments of the present invention. However, the scan driver and the sustain driver may be formed on one driving board.

The explanation was given of an example of the switching elements formed of the EFT in the embodiments of the present invention. However, the switching elements may be formed of another type of transistors, for example, an insulated gate bipolar transistor (IGBT).

As described above, according to the embodiments of the present invention, the voltage −Vy of the scan signal of the negative polarity direction, the voltage of the falling signal and the voltage Vs of the sustain signal are generated using one voltage source, or the voltage Vs of the sustain signal and the sustain bias voltage Vzb are generated using one voltage source. As a result, the fabricating cost of the plasma display apparatus according to the embodiments of the present invention decreases.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel comprising a scan electrode and an address electrode; and a driver for supplying a voltage of a scan signal having a negative polarity direction during an address period and for supplying a voltage of a sustain signal to the scan electrode during a sustain period using one voltage source.

2. The plasma display apparatus of claim 1, wherein the voltage source is a sustain voltage source.

3. The plasma display apparatus of claim 1, wherein the driver comprises:

a sustain voltage supply control unit for controlling the voltage of the sustain signal supplied to the scan electrode, a negative polarity scan voltage generating unit for generating the voltage of the scan signal having the negative polarity direction, and a scan voltage supply control unit for controlling the voltage of the scan signal having the negative polarity direction supplied to the scan electrode.

4. The plasma display apparatus of claim 3, wherein the negative polarity scan voltage generating unit comprises:

a voltage storing unit for storing the voltage of the sustain signal, and a buffer unit linked with the voltage storing unit.

5. The plasma display apparatus of claim 4, wherein the voltage storing unit comprises a first capacitor for storing the voltage of the sustain signal.

6. The plasma display apparatus of claim 3, wherein the negative polarity scan voltage generating unit comprises:

a voltage storing unit for storing the voltage of the sustain signal, a buffer unit linked with the voltage storing unit, and a voltage control unit for controlling a magnitude of the voltage stored in the voltage storing unit.

7. The plasma display apparatus of claim 6, wherein the voltage control unit is a variable voltage source.

8. The plasma display apparatus of claim 6, wherein one terminal of the voltage control unit is connected to a low level voltage supply source for supplying a voltage less than the sustain voltage, and the other terminal is grounded, and the low level voltage supply source is a data voltage source for supplying a data signal to the address electrode.

9. A plasma display apparatus comprising:

a plasma display panel comprising a scan electrode and an address electrode; and a driver for supplying a voltage of a scan signal having a negative polarity direction during an address period, a voltage of a falling signal having a gradually falling voltage during a reset period, and a voltage of a sustain signal during a sustain period to the scan electrode using one voltage source.

10. The plasma display apparatus of claim 9, wherein the voltage source is a sustain voltage source.

11. The plasma display apparatus of claim 9, wherein the driver comprises:

a sustain voltage supply control unit for controlling the voltage of the sustain signal supplied to the scan electrode, a negative polarity scan voltage generating unit for generating the voltage of the scan signal of the negative polarity direction, a scan voltage supply control unit for controlling the voltage of the scan signal having the negative polarity direction supplied to the scan electrode, and a falling voltage supply control unit for controlling the voltage of the falling signal supplied to the scan electrode.

12. The plasma display apparatus of claim 11, wherein the negative polarity scan voltage generating unit comprises:

a voltage storing unit for storing the voltage of the sustain signal, and a buffer unit linked with the voltage storing unit.

13. The plasma display apparatus of claim 11, wherein the negative polarity scan voltage generating unit comprises:

a voltage storing unit for storing the voltage of the sustain signal, a buffer unit linked with the voltage storing unit, and a voltage control unit for controlling a magnitude of the voltage stored in the voltage storing unit.

14. The plasma display apparatus of claim 13, wherein the voltage control unit is a variable voltage source.

15. The plasma display apparatus of claim 14, wherein the variable voltage source supplies a voltage of 1V to 30V.

16. The plasma display apparatus of claim 13, wherein one terminal of the voltage control unit is connected to a low level voltage supply source for supplying a voltage less than the sustain voltage, and the other terminal is grounded, and the low level voltage supply source is a data voltage source for supplying a data signal to the address electrode.

17. The plasma display apparatus of claim 16, wherein the low level voltage supply source supplies one voltage of 15V, 5V and −5V.

18. The plasma display apparatus of claim 4, wherein the buffer unit includes a load reduction resistance and a reverse blocking diode.

19. The plasma display apparatus of claim 6, wherein the buffer unit includes a load reduction resistance and a reverse blocking diode.

20. The plasma display apparatus of claim 12, wherein the buffer unit includes a load reduction resistance and a reverse blocking diode.

21. The plasma display apparatus of claim 13, wherein the buffer unit includes a load reduction resistance and a reverse blocking diode.

* * * * *